US007648409B1

(12) United States Patent
Horiguchi et al.

(10) Patent No.: US 7,648,409 B1
(45) Date of Patent: Jan. 19, 2010

(54) DOUBLE SIDE POLISHING METHOD AND APPARATUS

(75) Inventors: Akira Horiguchi, Kashiba (JP); Ken Isobe, Shijyonawate (JP); Heigo Tanaka, Karatsu (JP); Tomio Fukushima, Fujiidera (JP); Kiyohide Murata, Nishinomiya (JP); Tsunco Takeda, Kyoto (JP); Yoshiaki Uzu, Nara (JP); Hiroshi Matsumoto, Nara (JP)

(73) Assignees: Sumitomo Mitsubishi Silicon Corporation, Tokyo (JP); Kashiwara Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/743,502

(22) PCT Filed: May 17, 2000

(86) PCT No.: PCT/JP00/03159

§ 371 (c)(1),
(2), (4) Date: Jun. 7, 2001

(87) PCT Pub. No.: WO00/69597

PCT Pub. Date: Nov. 23, 2000

(30) Foreign Application Priority Data

May 17, 1999 (JP) ..... 11-135631
May 17, 1999 (JP) ..... 11-135637
May 17, 1999 (JP) ..... 11-135652

(51) Int. Cl.
*B24B 1/00* (2006.01)

(52) U.S. Cl. ..... 451/41; 451/54; 451/63; 451/262; 451/268; 451/335; 451/339

(58) Field of Classification Search ..... 451/41, 451/57, 63, 112, 269, 268, 265, 266, 274, 451/397, 402, 494, 495, 527, 548, 550, 54, 451/261, 262, 267, 271, 334, 335, 339, 398
See application file for complete search history.

(56) References Cited

U.S. PATENT DOCUMENTS 4,588,473 A * 5/1986 Hisatomi et al. ..... 438/460
5,333,413 A * 8/1994 Hashimoto ..... 451/9
5,422,316 A * 6/1995 Desai et al. ..... 438/693
5,914,053 A * 6/1999 Masumura et al. ..... 216/88

(Continued)

*Primary Examiner*—Eileen P. Morgan
(74) *Attorney, Agent, or Firm*—Morrison & Foerster LLP

(57) ABSTRACT

A method of polishing the double sides of a plurality of works simultaneously by rotating a plurality of carriers between upper and lower rotating surface plates, comprising the steps of forming the works (400) integrally with the carriers (500) on the outside of a polishing device main body (110), feeding the works (400) onto a rotating surface plate (111) on the underside of the polishing device main body (110) with the works formed integrally with the carriers (500), injecting liquid such as water from the upper side rotating surface plate when the upper side rotating surface plate is raised after the double sides are polished, holding the plurality of works (400) on the lower side rotating surface plate (111) after the double sides are polished, enabling the works (400) to be discharged automatically from the lower side rotating surface plate (111), providing a brush storage part (180) and a dresser storage part (190) near the polishing device main body (110), and frequently treating a polishing cloth installed on the opposed surfaces of the upper and lower rotating surface plates with a brush and a dresser.

13 Claims, 27 Drawing Sheets

U.S. PATENT DOCUMENTS 5,941,759 A * 8/1999 Kitajima et al. ..... 451/41
5,967,882 A * 10/1999 Duescher ..... 451/57
5,989,108 A * 11/1999 Ikeda et al. ..... 451/268
6,042,688 A * 3/2000 Masumura et al. ..... 156/345.14
6,050,880 A * 4/2000 Kato et al. ..... 451/41
6,196,901 B1 * 3/2001 Minami ..... 451/63
6,206,767 B1 * 3/2001 Suzuki et al. ..... 451/262
6,210,259 B1 * 4/2001 Malkin et al. ..... 451/166
6,220,931 B1 * 4/2001 Nishi et al. ..... 451/28
6,336,855 B1 * 1/2002 Ohmori et al. ..... 451/450
6,361,418 B1 * 3/2002 Inada ..... 451/262
6,419,564 B2 * 7/2002 Herrman et al. ..... 451/58

* cited by examiner

DOUBLE SIDE POLISHING METHOD AND APPARATUS

TECHNICAL FIELD

The present invention relates to a double side polishing method and apparatus for use in, for example, double side polishing of a silicon wafer.

BACKGROUND ART

A silicon wafer, which is a material of a semiconductor device, is cut out from a silicon single crystal, lapped, and then polished so as to have a mirror surface. This mirror finish was provided only on a device formation surface, but for wafers of a large diameter exceeding 8 inches, for example, 12-inch wafers, there has been a need to finish them in such a manner that their rear surface, on which no device is formed, is comparable to a mirror one. It has correspondingly been necessary to polish both surfaces of the wafers.

A planetary gear-based double side polishing apparatus is normally used for double side-polishing of a silicon wafer. The structure of this double side polishing apparatus will be described in brief with reference to FIGS. 26 and 27. FIG. 27 is taken along a line C-C in FIG. 26 which is indicated by arrows.

The planetary gear-based double side polishing apparatus comprises a vertical pair of rotary surface plates 1 and 2, a plurality of carriers 3, 3, . . . arranged around a rotation center between the rotary surface plates 1 and 2 as planetary gears, a sun gear 4 arranged at the rotation center between the rotary surface plates 1 and 2, and an annular internal gear 5 arranged in an outer periphery between the rotary surface plates 1 and 2.

The upper rotary surface plate 1 can be elevated and lowered and rotates in a direction opposite to that for the lower rotary surface plate 2. The rotary surface plates 1 and 2 each have a polishing cloth (not shown) installed on its surface opposite to the other. Each carrier 3 has an eccentric circular accommodation hole in which a circular work 6 comprising a silicon wafer is held. The sun gear 4 and the internal gear 5 engage with the plurality of carriers 3 from the inside and outside, respectively, and are normally driven rotationally in the same direction as the lower rotary surface plate 2.

During a polishing operation, with the upper rotary surface plate 1 lifted, the plurality of carriers 3, 3, . . . are set on the lower rotary surface plate 2 and the work 6 is conveyed into each of the carriers 3, which are then supplied onto the rotary surface plate 2. Once all the works 6, 6, . . . have been provided, the upper rotary surface plate 1 is lowered to sandwich the works 6, 6, . . . between the rotary surface plates 1 and 2, more specifically, between the upper and lower polishing cloths. Then, a grinding liquid is poured between the rotary surface plates 1 and 2 while the sun gear 4 and the internal gear 5 are rotationally driven.

This rotational driving causes the plurality of carriers 3, 3, . . . to rotate between the rotary surface plates 1 and 2, which rotate in opposite directions, while revolving them around the sun gear 4. This allows the plurality of works 6, 6, . . . to be simultaneously polished on both sides.

It is an important technical object to automate such a double side polishing operation for silicon wafers, but the automation has been hindered for the following reasons.

(First Reason)

To automate the double side polishing operation for silicon wafers, for example, the plurality of works 6, 6, . . . must automatically be supplied onto the lower rotary surface plate 2. For this automatic supply, it has been contemplated that with the lower rotary surface plate 2 fixed, a sucking type transfer and loading robot simultaneously or sequentially conveys the works 6, 6, . . . into the plurality of carriers 3, 3, . . . set on the lower rotary surface plate 2.

If, however, the works 6 are 12-inch silicon wafers, the sizes of the rotary surface plates 1 and 2, the internal gear 5, and other peripheral components increase consistently with the size of the work 6 to increase tolerances, resulting in inaccurate positions of the carriers 3, 3, . . . placed on the lower rotary surface plate 2. On the other hand, the tolerance between the inner diameter of the carrier 3 and the outer diameter of the work 6 is more strictly limited. Thus, with the method of mechanically conveying the works 6, 6, . . . into the carriers 3, 3, . . . on the rotary surface plate 2, the work 6 may not completely be fitted in the carrier 3, thereby requiring monitoring and corrections by an operator. This has thus been found to be a major factor for hindering perfect automation.

(Second Reason)

To automate the double side polishing operation for silicon wafers, the plurality of works 6, 6, . . . must not only supplied onto the lower rotary surface 2 but the plurality of polished works 6, 6, . . . must also be automatically ejected from the lower rotary surface plate 2. The automatic ejection is achieved by a sucking type transfer and loading robot by sequentially unloading the works 6, 6, . . . from the carriers 3, 3, . . . on the lower rotary surface plate 2.

For the double side polishing, however, the polished works 6, 6, . . . are in relatively tight contact with the upper and lower polishing clothes. Thus, when the upper rotary surface plate 1 is lifted after the polishing, some of the works 6, 6, . . . may be held on the upper rotary surface plate 1 and may separate from the works 6, 6, . . . remaining on the lower rotary surface plate 2. Of course, such a work separation phenomenon seriously hinders automatic ejection of the works from the lower rotary surface plate 2.

As measures for preventing this work separation phenomenon, it has been contemplated that a plurality of rammers are provided on the upper rotary surface plate 1 in such a fashion as to correspond to the plurality of works 6, 6, . . . between the rotary surface plates 1 and 2 and that when the rotary surface plate 1 is lifted after the polishing, the plurality of rammers mechanically push the plurality of works 6, 6, . . . downward. As additional measures, Japanese Patent Laid-Open No. 9-88920 discloses a technique with which a plurality of suction nozzles are provided on the upper rotary surface plate 1 in such a fashion as to correspond to the plurality of works 6, 6, . . . so that when the rotary surface plate 1 is lifted after the polishing, all the works 6, 6, between the rotary surface plate 1 and 2 are sucked and held on the upper rotary surface plate 1.

Both measures can concentrate all the works 6, 6, . . . on one of the rotary surface plates 1 and 2. The former case, however, may mechanically damage the works 6, 6, . . . after the polishing, and this damage may create a serious problem. Examinations by the inventors show that the latter case does not mechanically stress the works 6, 6, . . . after the polishing but may cause the bottom surfaces of the works 6, 6, . . . separated from the lower rotary surface plate 2 to dry as the upper rotary surface plate 1 rises. This drying is a serious problem with silicon wafers.

(Third Reason)

In such a double side polishing operation for silicon wafers, the polishing clothes installed on the opposite surfaces of the rotary surface plates 1 and 2 are cleaned by means of brushing before the polishing operation. The brushing process is carried out by rotating and revolving brushes shaped like gears with the same outside shape as that of the carriers 3, but the supply and ejection of the brushes is carried out by the operator by manually supplying the brushes onto the lower rotary surface plate 2 and after the operation, ejecting the brushes therefrom.

Since the brushing is not frequently carried out, such manual supply and ejection of the brushes poses no particular problem. Since, however, high polishing quality is required to polish both surfaces of 12-inch silicon wafers, the brushing is required for each polishing operation. It has thus been found that if the brushes are manually supplied and ejected, a resulting decrease in working efficiency and a resulting increase in working costs create a serious problem.

That is, it is an important technical problem to automate the double side polishing of silicon wafers. For this automation, for example, the plurality of works 6, 6, . . . must be automatically supplied onto the lower rotary surface plate 2 and the polished works 6, 6, . . . must be automatically ejected from the lower rotary surface plate 2. The examinations by the inventors, however, have also shown that the manual supply and ejection of the brushes, like the manual supply and ejection of works, may significantly reduce working efficiency and increase working costs and that no effective automated apparatus has been established.

In addition to the brushing, dressing is used as mechanical processing for the polishing cloths. This processing is conventionally carried out to level the surfaces after the polishing cloths have been changed. However, it has been shown that the double side polishing of, for example, 12-inch silicon wafers, which requires a high quality operation, requires one dressing process to be executed at least every several polishing process in order to obtain sufficient quality and that this dressing process also significantly obstruct the automation for double side polishing apparatuses that pursue high quality.

It is an object of the present invention to eliminate the various factors that hinders the automation of the double side polishing operation to enable perfect automation.

That is, it is a first object of the present invention to provide a double side polishing method and apparatus that enable even large-diameter works such as 12-inch silicon wafers to be perfectly automatically supplied onto the lower rotary surface plate.

It is a second object of the present invention to provide a double side polishing method and apparatus that enables works to be automatically ejected from between the upper and lower rotary surface plates while reliably preventing the works from being mechanically damaged or dried.

It is a third object of the present invention to provide a double side polishing apparatus that can efficiently and economically carry out high-quality double side polishing with frequent brushing or dressing.

It is another object of the present invention to provide a double side polishing apparatus that can polish large works accurately, efficiently, and inexpensively while preventing them from being contaminated.

It is still another object of the present invention to provide a double side polishing apparatus that can increase the usage of a grinding liquid supplied between the upper and lower surface plates to preclude it from entering a drive section.

It is yet another object of the present invention to provide a double side polishing apparatus and carriers for use therein that can effectively prevent wafers held in the carriers from being damaged due to idle running.

It is further another object of the present invention to provide a double side polishing apparatus that can prevent contaminations and damages as large as possible, which become problems at the time of forming a device.

DISCLOSURE OF THE INVENTION

A first double side polishing method according to the present invention at least rotates a plurality of carriers holding works to be polished, between an upper and a lower rotary surface plates to simultaneously polish both surfaces of a plurality of works held by the plurality of carriers, and comprises steps of merging each work with the carrier before supplying it onto the lower surface plate and then supplying the work merged with the carrier, onto the lower surface plate in a merged state.

A first double side polishing apparatus according to the present invention includes a polishing apparatus main body for at least rotating a plurality of carriers holding works to be polished, between an upper and a lower rotary surface plates to simultaneously polish both surfaces of a plurality of works held by the plurality of carriers, a merging mechanism for merging each work with the carrier outside the polishing apparatus main body, and a supply mechanism for supplying the work merged with the carrier outside the polishing apparatus main body, to the lower surface plate in a merged state.

Since a plurality of carriers are conventionally placed on the lower surface plate beforehand, the positional accuracy of the carriers decreases disadvantageously. The first double side polishing method and apparatus does not place the carrier on the lower surface plate before supplying the work onto the lower surface plate but merges the wafer with the carrier before supplying the work, that is, outside the polishing apparatus main body. Consequently, even a 12-inch silicon wafer can be reliably merged with the carrier to eliminate the needs for monitoring or corrections by an operator, thereby enabling the work to be perfectly automatically supplied onto the lower surface plate.

In the first double side polishing method and apparatus according to the present invention, the polished work may be ejected from the lower surface plate separately from the carrier or may remain merged therewith during the ejection, but the latter is more preferable in simplifying the structure of the apparatus. That is, when the polished work remains merged with the carrier during ejection from the lower surface plate, the supply mechanism for supplying the works and the carriers onto the lower surface plate can be used as a mechanism for ejecting them.

The merging mechanism preferably includes a first aligning mechanism for aligning the carrier, a second aligning mechanism for aligning the work before merging it with the carrier, and a conveying mechanism for conveying the aligned wafer into the aligned carrier because such a merging mechanism enables a reliable merging operation with a simple apparatus structure.

In supplying the works onto the lower surface plate, the lower surface plate is conventionally fixed so that the works are conveyed to a plurality of positions thereon, but this supply form involves a complicated work conveying mechanism, thereby reducing conveying accuracy. Accordingly, the works are preferably conveyed to their specified positions by performing an indexing operation of rotating the lower surface plate through a predetermined angle for each operation.

In this case, the lower surface plate is desirably indexed so as not cause the carriers already placed on the lower surface plate to move relative to the lower surface plate. The carriers already placed on the lower surface plate float therefrom and are easily movable. If they move, the works become misaligned and have their bottom surfaces polished inappropriately. This problem is solved by hindering the relative movement of the carriers during the indexing operation.

If the polishing apparatus main body is of a type that rotates the plurality of carriers at their specified positions, there is no integral internal gear that engages externally with the plurality of carriers, thereby facilitating the indexing operation without causing the relative movement of the carriers.

The supply of the works to their specified positions combined with the indexing operation is applicable not only to the merging of the work with the carrier before supply to the polishing apparatus main body but also to the combination of the works with the plurality of carriers previously set in the polishing apparatus main body; the latter provides similar effects.

A second double side polishing method according to the present invention at least rotates a plurality of carriers holding works to be polished, between an upper and a lower rotary surface plates to simultaneously polish both surfaces of a plurality of works held by the plurality of carriers, and comprises steps of providing a plurality of fluid nozzles in the upper rotary surface plate and/or the lower rotary surface plate opposite to the plurality of works between the rotary surface plates, the nozzles being opened in surfaces of the surface plate, and on separating the upper and lower rotary surface plates from each other after double side polishing has been completed between the upper and lower rotary surface plates, injecting a liquid against the plurality of works from the upper fluid nozzles and/or causing the lower fluid nozzles to suck them in order to hold them on the lower rotary surface plate.

A second double side polishing apparatus according to the present invention includes a polishing apparatus main body for at least rotating a plurality of carriers holding works to be polished, between an upper and a lower rotary surface plates to simultaneously polish both surfaces of a plurality of works held by the plurality of carriers, in which a plurality of fluid nozzles are provided in the upper rotary surf ace plate and/or the lower rotary surf ace plate opposite to the plurality of works between the rotary surface plates, the nozzles being opened in surfaces of the surface plate, and the plurality of fluid nozzles provided in the upper rotary surface plate are connected to a liquid supply mechanism, while the plurality of fluid nozzles provided in the lower rotary surface plate are connected to a suction mechanism.

In the second double side polishing method and apparatus according to the present invention, when the rotary surface plates are separated from each other after the double side polishing has been completed, all the works between the rotary surface plates are reliably held on the lower rotary surface plate by means of a fluid pressure based on injection of a fluid from above and/or downward suction. Once the polishing has been completed, the lower rotary surface plate is filled with a liquid such as a grinding liquid, so that the works are prevented from drying when held on the rotary surface plate. Moreover, the liquid injection from above does not mechanically damage the works and prevents them from drying. It rather supplies the liquid to top surfaces of the works to positively prevent them from drying.

One or both of the liquid injection from above and the downward suction may be used. If, however, the works are sucked downward over a long time, the liquid collected on the lower rotary surface plate may be eliminated to dry bottom surfaces of the works. Thus, preferably, the liquid injection from above is essential and is combined with the downward suction as required. If the downward suction is omitted, all the works between the rotary surface plates can be held on the lower rotary surface plate as long as the liquid injection from above is carried out. If the downward suction is used, a long-time operation is preferably avoided.

The plurality of fluid nozzles are preferably not provided all over the surface of the rotary surface plate but only at positions corresponding to the plurality of works between the rotary surface plates because the fluid pressure can be effectively used. In this case, after the polishing has been completed, the rotary surface plate must be stopped where the plurality of fluid nozzles are opposite to the corresponding surfaces of the plurality of works.

A third double side polishing apparatus according to the present invention at least rotates a plurality of carriers holding works to be polished, between an upper and a lower rotary surface plates to simultaneously polish both surfaces of a plurality of works held by the plurality of carriers, and comprises a housing section arranged between the upper and lower rotary surface plates instead of the plurality of carriers and at least rotating between the upper and lower rotary surface plates similarly to the carriers to house a plurality of processing bodies for processing polishing cloths installed on opposite surfaces of the upper and lower rotary surface plates, and a conveying section for supplying the plurality of processing bodies between the upper and lower rotary surface plates from the housing section and ejecting the used processing bodies from between the upper and lower rotary surface plates.

The processing bodies include brushes for cleaning the polishing cloths and/or dressers for leveling surfaces thereof.

The third double side polishing apparatus according to the present invention automatically supplies not only the works but also the brushes or dressers, thereby avoiding a decrease in working efficiency and an increase in working costs even when the polishing clothes are frequently brushed or dressed. Consequently, high-quality double side polishing is efficiently and economically achieved with frequent brushing or dressing to enable dressing for each double side polishing operation.

The brushing is preferably considered to be more important than the dressing. Thus, desirably, the automation of the brushing is essential and is combined with the automation of the dressing as required.

The conveying section preferably also configures a work conveying section for supplying unpolished works between the upper and lower rotary surface plates and ejecting the polished works from between the upper and lower rotary surface plates, in order to make the apparatus more efficient.

The polishing apparatus main body preferably includes a pair of rotary surface plates for polishing both surfaces of the works, a plurality of gear-shaped carriers arranged in a periphery of a rotation center between the pair of rotary surface plates to eccentrically hold the works, a center gear arranged in the rotation center between the pair of rotary surface plates to engage with the plurality of carriers arranged in the periphery to synchronously rotate them, and a plurality of auto rotation means distributed around the plurality of carriers so as to correspond to them and each engaging with the carrier located inside the auto rotation means to hold and automatically rotate this carrier at its specified position in corporation with the center gear.

Preferably, the plurality of auto rotation means each engages with the carrier at one or two positions and automatically rotate it using one or more rotary gears each having a tooth trace along a rotation axis. Additionally, worm gears are preferably used to automatically rotate the carriers.

The rotary gears are preferably movable in the direction of the rotation axis or may comprise a plurality of thin gears laminated in the rotation axis direction, or both of these structures may be combined together.

The revolution of the carriers is conventionally considered to be indispensable for a high polishing accuracy. Larger works, however, require the size of the internal gear, which revolves the carriers, to be increased, thereby increasing manufacturing errors and reducing the polishing accuracy. If larger works are to be polished, a high polishing accuracy can be more easily achieved by omitting the internal gear, which may contribute to reducing the polishing accuracy, so that each carrier is automatically rotated at its specified position by a smaller gear. The omission of the internal gear is also very effective in reducing the scale and costs of the apparatus.

When the carriers are automatically rotated at their specified positions using smaller gears, these gears can be made of a resin. The resin gears can avoid contamination of wafers with metallic powders. On the other hand, they are rapidly abraded in their portions engaging with the thin carriers. This abrasion may reduce the polishing accuracy and must thus be prevented. Consequently, the gears must frequently be replaced with new ones to increase polishing costs. To solve this problem, it is effective to move the gears in the rotation axis direction or divide them into groups in the same direction so as to be replaced in groups. Worm gears can also be used.

That is, the use of the rotary gears reduces manufacturing costs. When the rotary gears are movable in the rotation axis direction, local abrasion caused by the engagement between the rotary gears and the carries is restrained to reduce the frequency with which the rotary gears are replaced, thereby reducing the polishing costs. When the plurality of thin gears are laminated in the rotation axis direction, abraded gears alone can be replaced to reduce the polishing costs. The costs are particularly reduced when both of these structures are combined together.

The rotary gears are made of either metal or non-metal; among non-metals, reins are particularly preferable. The rotary gears of a resin can avoid contamination of the works with metallic powders to restrain the expensive carriers from being abraded as described above. An increase in polishing costs caused by the abrasion of the rotary gears can be effectively avoided by combining this composition with each of the described structures. Resins such as monomer casting nylon and PCV are preferable in terms of funding cost, mechanical strength, workability, or the like.

The rotary gears are essentially spur gears having a tooth trace parallel with the rotation axis but may be helical gears having a tooth trace slightly inclined from the rotation axis (for example, through 10° or less). Additionally, they are not limited to normal ones having mountains and valleys repeated in a circumferential direction but may have pins arranged at predetermined intervals in the same direction.

Preferably, the auto rotation means are each structured to engage the rotary gear with the carrier at two or more positions in order to allow the carriers to be held at their specified positions. When the rotary gears are movable in the rotation axis direction, they can be withdrawn from their specified positions to enable the carriers to be easily sent and removed. The structure for withdrawing the rotary gears is not necessarily based on the movement in the rotation axis direction but may be based on radial or diagonal movement.

In addition, unlike the spur gears worm gears are each arranged so as to have its rotation axis is substantially parallel with a tangent of the carrier located inside this worm gear and to be in line contact with this carrier in the circumferential direction. Thus, even if the worm gears are made of a resin, they are restrained from being abraded. Additionally, a single gear enables the carrier to be reliably held in its specified position, thereby particularly simplifying the configuration of the auto rotation means. That is, two spur gears must be provided outside the carrier to reliably hold the carrier located inside the gear, at its specified position, but only one worm gear is required to achieve the same purpose; two are not particularly required.

The worm gears are generally of a straight type (see FIG. 19(*a*)) that has a constant outer diameter in the rotation axis direction, but a hand drum type (see FIG. 19(*b*)) may be used which has its outer diameter varying in a fashion corresponding to an outer circumferential arc of the carrier located inside the gear. The latter, which contacts with the carrier over a long distance, is more preferable in restraining abrasion.

The worm gears are made of either metal or non-metal; among non-metals, reins are particularly preferable. The worm gears of a resin can avoid contamination of the works with metallic powders to restrain the expensive carriers from being abraded. Resins such as monomer casting nylon and PCV are preferable in terms of funding cost, mechanical strength, workability, or the like.

The plurality of auto rotation means can be synchronously driven by a common drive source. The common drive source can also be used to drive the center gear. Alternatively, a separate drive source can be used to electrically synchronously drive the rotation means and center gear.

Further, the polishing apparatus main body is based on a method of polishing both surfaces of the wafer held on each carrier by arranging the plurality of carriers holding the wafers between the upper and lower rotary surface plates at predetermined intervals in the rotation direction, and engaging each carrier with a sun gear located in the center of the surface plate and inner gears located in a periphery thereof, to cause each carrier to make a planetary motion between the upper and lower rotary surface plates. Preferably, a plurality of supply passages of grinding liquid in the upper rotary surface plate for supplying a grinding liquid between the upper and lower rotary surface plates are formed in the upper rotary surface plate and the sun gear is integrated with the lower rotary surface plate in its center.

In this polishing apparatus main body, since the sun gear is integrated with the lower rotary surface plate, the grinding liquid supplied between the upper and lower rotary surface plates is ejected only from the gap between the inner gears located in the outer periphery and the lower rotary surface plate. As a result, the grinding liquid remains between the upper and lower rotary surface plates for a longer time to improve the its usage and is prevented from entering the drive section, which concentrates in the center. When the grinding liquid is concentrically supplied to the center, it is moved to the outer periphery due to a centrifugal force to further improve its usage.

When the sun gear is integrated with the lower rotary surface plate, the sun gear cannot be independently driven relative to the lower rotary surface gear. If the upper rotary surface plate is engaged with the sun gear, the upper and lower rotary surface plates are synchronously rotated at an equal speed. Since, however, the sun gear rotates with the lower rotary surface plate, the carriers make a planetary motion. Additionally, the difference in speed between the upper rotary surface plate and the carriers causes the grinding liquid to be sucked. To set a difference in speed between the upper and lower rotary surface plates, the upper rotary surface plate may be independently rotationally driven with respect to the lower rotary surface plate.

The polishing apparatus main body is preferably based on a method of polishing both surfaces of wafers held in corresponding carriers by causing annular carriers individually holding wafers inside to make a planetary motion between the upper and lower surface plates, the carriers each having a projection on an inner circumferential surface thereof, the projection being fitted in a notch formed in an outer circumferential surface of the wafer.

In addition, the carrier according to the present invention has a wafer fitted therein, the wafer having its both surface polished, and has a projection on an inner circumferential surface thereof, the projection being fitted in a notch formed in an outer circumferential surface of the wafer.

The wafer has a notch such as a V notch or an orientation flat formed therein and representing a crystal orientation thereof. When the carrier has the projection on the inner circumferential surface thereof, the projection being fitted in the notch formed in the outer circumferential surface of the wafer, the wafer held in the carrier is always rotated integrally with the carrier.

Preferable carrier materials include CFRP (Carbon Fiber Reinforced Plastic) or high-strength anti-abrasion plastic. Alternatively, the above described resin reinforced with stainless steel, glass fibers, or the like, for example, an epoxy resin, a phenol resin, or a nylon resin can be used. Carriers made of a resin other than the high-strength anti-abrasion plastic preferably has their inner circumferential surfaces coated with the high-strength anti-abrasion plastic.

The carriers preferably have their inner circumferential surfaces coated with a resin of a small friction resistance. This prevents the inner circumferential surfaces of the carriers from being abraded despite changes in abutting surfaces of the carriers and wafers associated with the polishing.

The resin of a small friction resistance coated on the inner circumferential surface of each carrier may be polymeric polyethylene, an epoxy resin, a fluorine resin, PPS, cerasol, PEEK, PES, or the like.

The double side polishing apparatus according to the present invention uses a wafer transfer and loading apparatus as an additional facility. This wafer transfer and loading apparatus comprises a robot arm moving in at least two directions to transfer and load the wafers supported in a horizontal direction of the apparatus, and a chuck attached to the robot arm to suck a top of the wafer, wherein the chuck is preferably of an outer-circumference annular sucking type that comes in contact with a top surface of a periphery of the wafer in the form of an annulus ring and that has a plurality of suction ports in the annular contact surface, the suction ports being formed in a circumferential direction of the apparatus at intervals.

According to this wafer transfer and loading apparatus, the outer-circumference annular sucking chuck comes in contact with the top surface of the wafer but the contact area of the wafer is limited to its periphery. No device is normally formed in the periphery of the wafer, so that this portion can be gripped during a handling operation. Further, since the chuck contacts the entire circumference of the periphery of the wafer, the wafer can be reliably held despite the partial contact.

The wafer transfer and loading apparatus alternatively comprises a robot arm moving in at least two directions to transfer and load the wafers supported in a horizontal direction of the apparatus, and a chuck attached to the robot arm to bear the wafer from below while sucking a bottom surface thereof, wherein the chuck is preferably of an outer-circumference arc-shaped sucking type that comes in contact with a circumferential part of a bottom surface of a periphery of the wafer in the form of a circular arc and that has a plurality of suction ports in the circular arc contact surface, the suction ports being formed in a circumferential direction of the apparatus at intervals.

According to this wafer transfer and loading apparatus, the outer-circumference circular sucking chuck comes in contact with the bottom surface of the wafer but the contact area of the wafer is limited to its periphery. No device is normally formed in the periphery of the wafer, so that this portion can be gripped during a handling operation. Further, since the chuck contacts the entire circumference of the periphery of the wafer, the wafer can be reliably held despite the partial contact.

BRIEF DESCRIPTION OF THE DRAWINGS

FIG. 24(*a*) is a top view and FIG. 24(*b*) is a side view.

FIG. 25(*a*) is a top view and FIG. 25(*b*) is a side view.

BEST MODES FOR IMPLEMENTING THE INVENTION

Preferred embodiments of a double side polishing apparatus according to the present invention will be described with reference to FIGS. 1 to 11.

Figure 1:
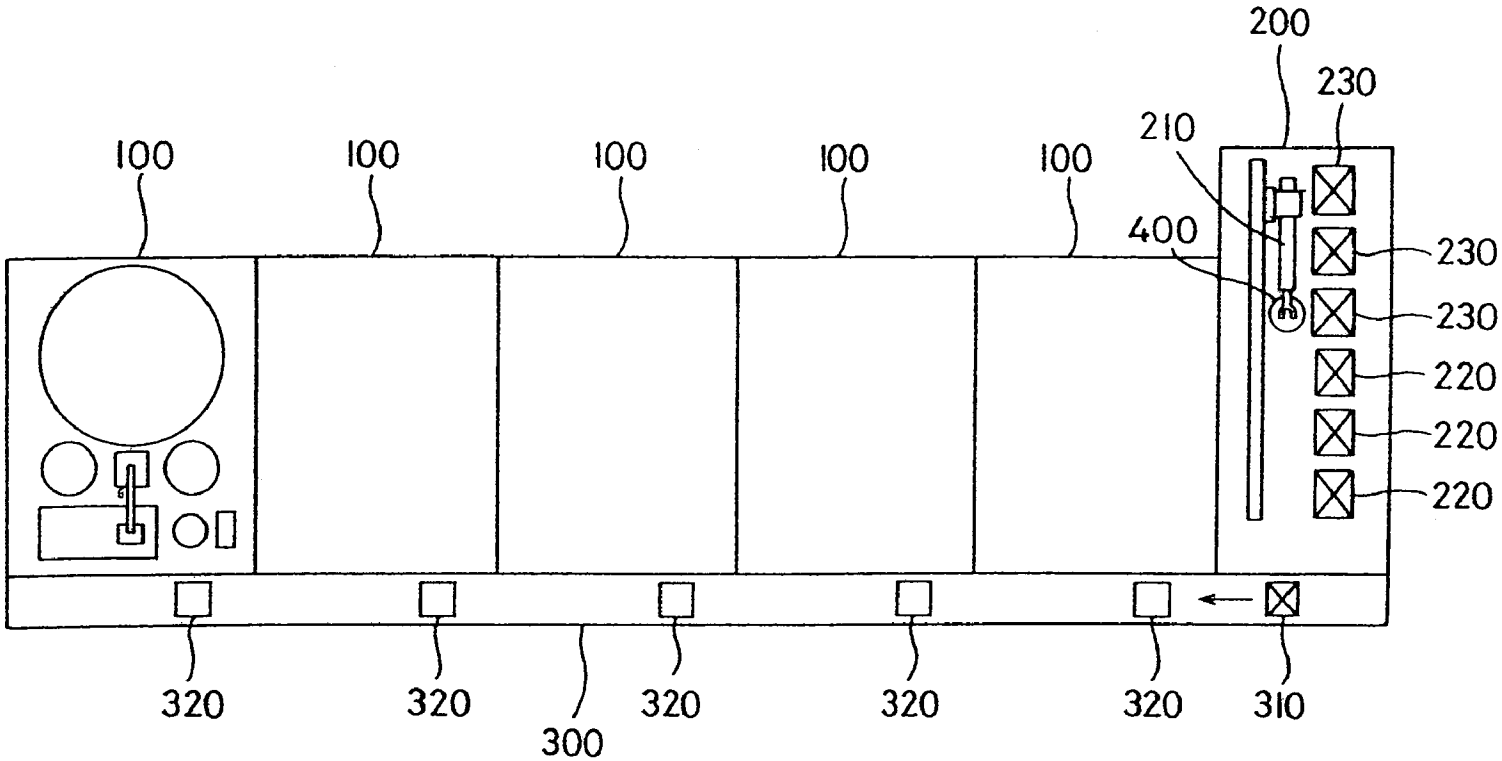
FIG. 1 is a top view of a double side polishing facility according to an embodiment of the present invention.

The double side polishing apparatus shown in FIG. 1 is used for automated double side polishing of silicon wafers. This double side polishing facility comprises a plurality of double side polishing apparatuses 100, 100, . . . arranged in a lateral direction of the facility, a loader unloader apparatus 200 arranged at a side of the double side polishing apparatuses, and a basket conveying apparatus 300 joining these apparatuses together.

The loader unloader apparatus 200 comprises a sucking type work conveying robot 210. The sucking type work conveying robot 210 picks out an unpolished work 400 comprising a silicon wafer from a loading basket 220, and transfers and loads it in a conveying basket 310 in the basket conveying apparatus 300. In addition, the sucking type work conveying robot 210 picks out a polished work 400 from the conveying basket 310 and transfers and loads it in an unloading basket 230.

The conveying basket 310 accommodates a plurality of works 400, 400, . . . therein in such a manner that they overlap one another at predetermined intervals in a vertical direction of the apparatus.

The basket conveying apparatus 300 comprises a plurality of lifting mechanisms 320, 320, . . . corresponding to the plurality of double side polishing apparatuses 100, 100, . . . to selectively convey the conveying basket 310 with the unpolished work 400 accommodated therein from the loader unloader apparatus 200 to one of the plurality of lifting mechanisms 320, 320, . . . . The basket conveying apparatus 300 also conveys the conveying basket 310 with the polished work 400 accommodated therein from the lifting mechanism 320, 320, . . . to the loader unloader apparatus 200.

The lifting mechanism 320 lifts and lowers the conveying basket 310 at a pitch corresponding to an accommodation alignment pitch for the works 400, 400, . . . in order to allow each of the plurality of works 400, 400, . . . accommodated in the conveying basket 310 to be received by the corresponding double side polishing apparatus 100.

Figure 2:
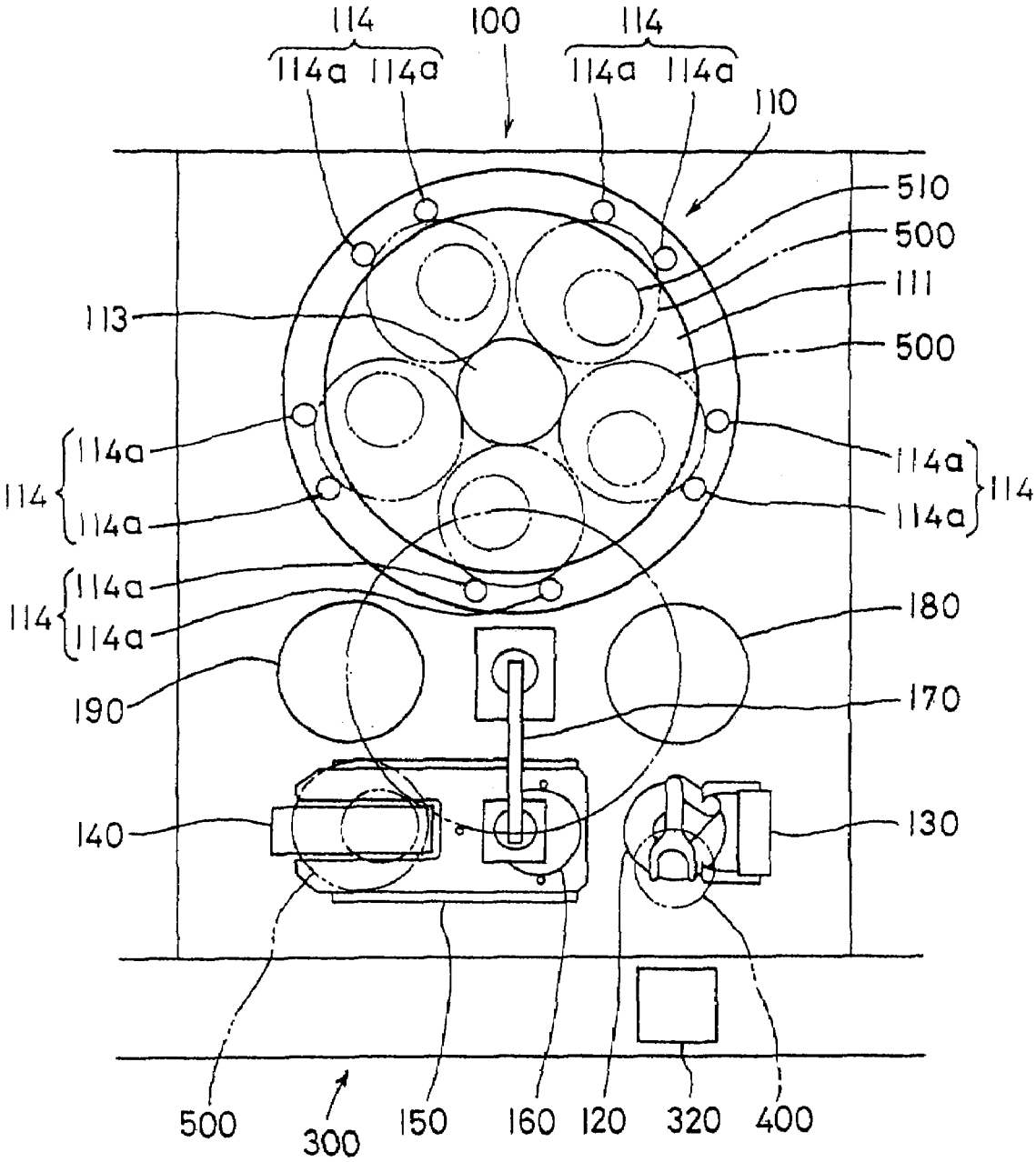
FIG. 2 is a top view of a double side polishing apparatus used in the double side polishing facility.

The double side polishing apparatus 100 comprises a polishing apparatus main body 110, a first work conveying section 120, a work aligning section 130, a carrier housing section 140, a carrier conveying section 150, a carrier aligning section 160, a second work conveying section 170, a brush housing section 180, and a dresser housing section 190 all mounted on a common base frame, as shown in FIG. 2.

The polishing apparatus main body 110 comprises a lower rotary surface plate 111, an upper rotary surface plate 112 (see FIG. 5) concentrically combined therewith from above, a center gear 113 provided in the center of the lower rotary surface plate 111, and a plurality of auto rotation means 114, 114, . . . provided in a periphery of the lower rotary surface plate 111.

The lower rotary surface plate 111 supports a plurality of carriers around the center gear 113. The carriers 500 are each a circular external gear and has a circular accommodation hole 510 at a position eccentric to its center such that a silicon wafer that is the work 400 is accommodated in the accommodation hole 510.

Figure 3:
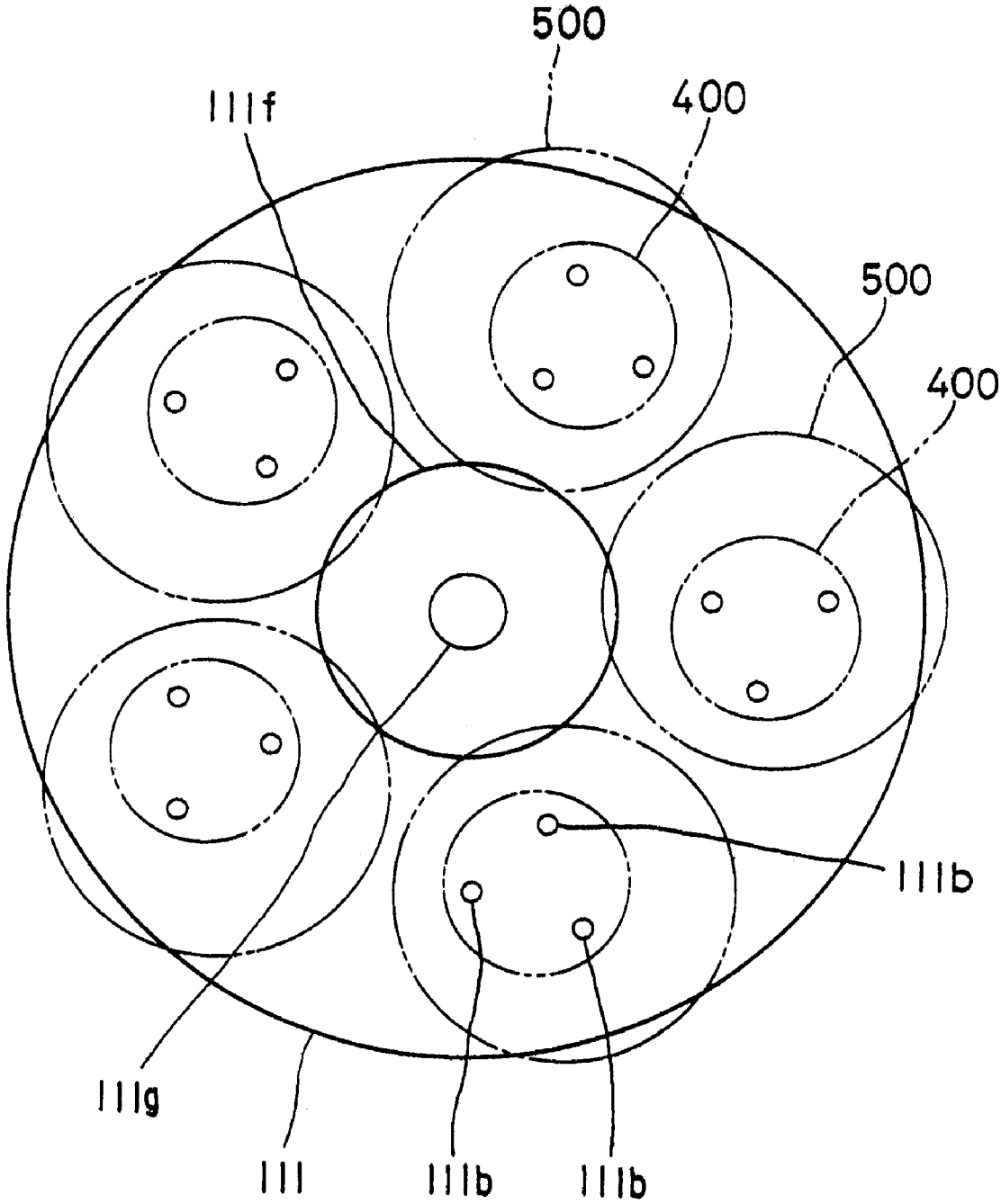
FIG. 3 is a top view of a lower rotary surface plate.
Figure 4:
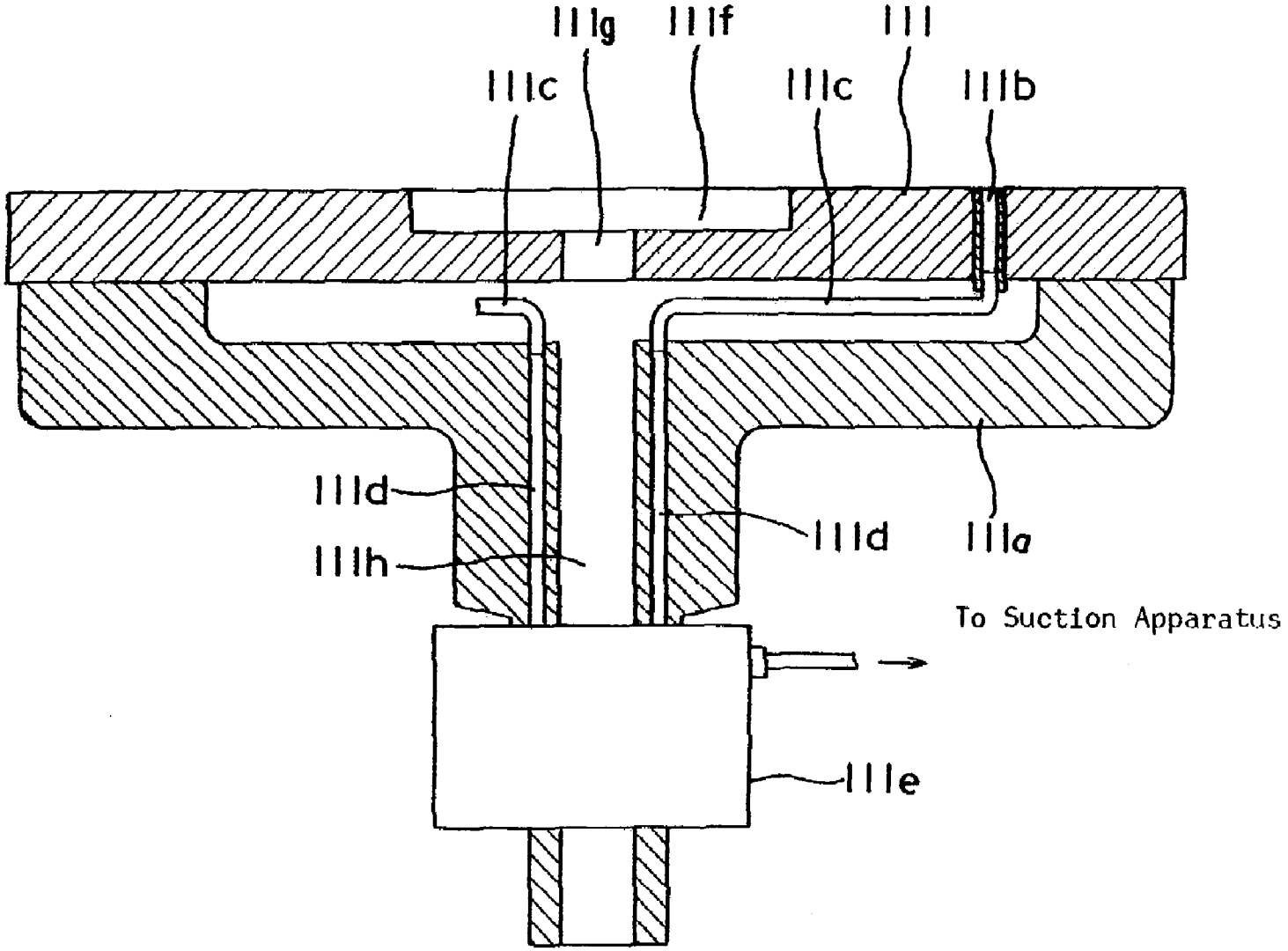
FIG. 4 is a vertical sectional view of the lower rotary surface plate.

The rotary surface plate 111 is a disk having an opening in the center thereof and is mounted on a disk section of a rotary support member 111*a* having a cavity in the center thereof, as shown in FIGS. 3 and 4. The rotary support member 111*a* is rotationally driven in a predetermined direction by a drive mechanism (not shown) to rotate the rotary surface plate 111 in a predetermined direction and to stop at a home position. The home position is a reference stop position at which the rotary surface plate 111 is stopped before and after polishing, particularly after it.

The rotary surface plate 111 has a plurality of nozzles 111*b*, 111*b* . . . penetrating the surface plate 111 in its thickness direction. The plurality of nozzles 111B, 111*b*, . . . are provided so as to correspond to the work 400 in the carrier 500 when the rotary surface plate 111 is stopped at the original position. These nozzles 111*b*, 111*b*, . . . are connected to a suction apparatus (not shown) via conduits 111*c*, 111*c*, . . . provided between the rotary surface plate 111 and the disk section of the rotary support member 111*a*, vertical holes 111*d*, 111*d*, . . . formed in a shaft section of the rotary support section 111*a*, a rotary joint 111*e* attached to the shaft section, and other components.

Figure 5:
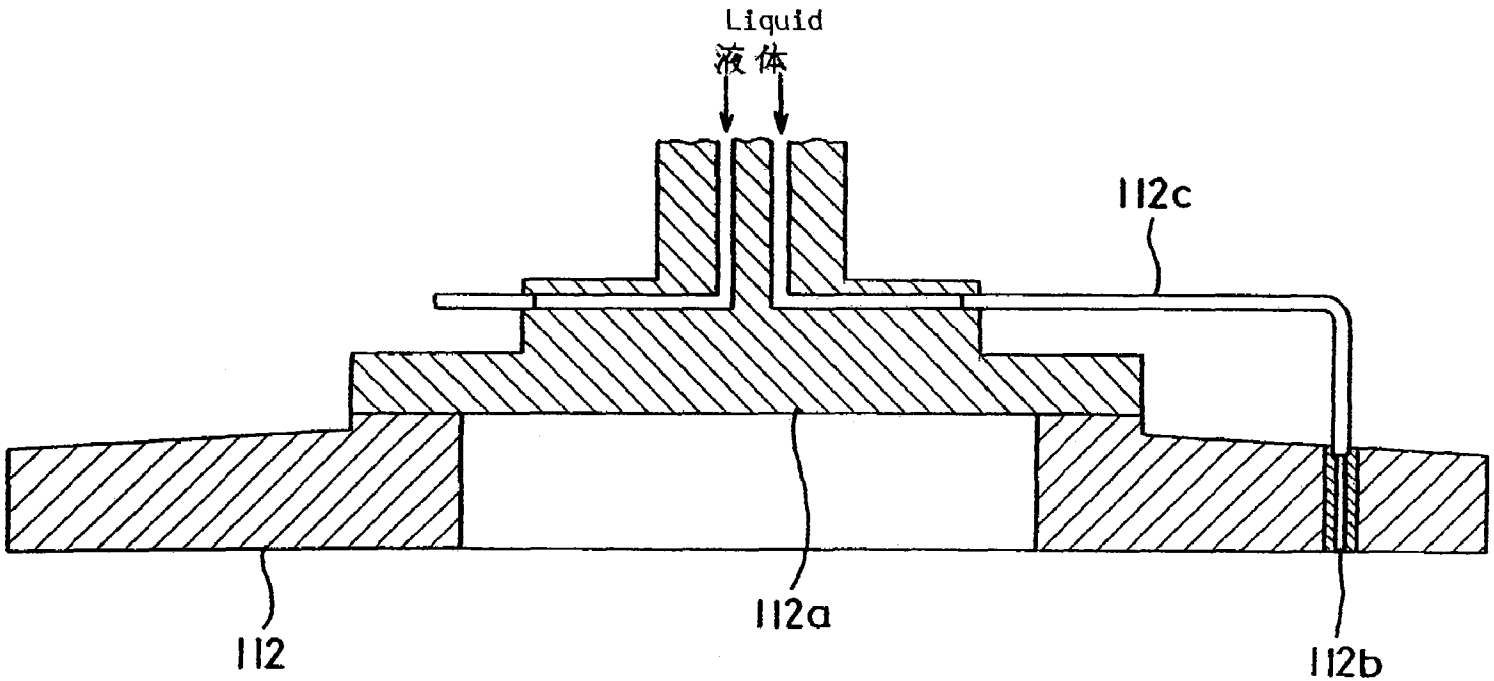
FIG. 5 is a vertical sectional view of an upper rotary surface plate.

The upper rotary surface plate 112 is an annular disk and is attached to a bottom surface of a disk section of the rotary support member 112*a*, as shown in FIG. 5. The rotary support member 112*a* is driven to elevate and lower and rotate by means of the drive mechanism (not shown). This allows the rotary surface plate 112 to elevate from and lower to the lower rotary surface plate 111, to rotate in a direction opposite to that of the rotary surface plate 111, and to stop at the home position.

The rotary surface plate 112 has a plurality of nozzles 112*b*, 112*b*, . . . penetrating the surface plate 112 in its thickness direction similarly to the rotary surface plate 111. Like the nozzles 111*b*, 111*b*, . . . , the plurality of nozzles 112*b*, 112*b*, . . . are provided so as to correspond to the work 400 in the carrier 500 when the rotary surface plate 112 is stopped at the home position. These nozzles 112*b*, 112*b*, . . . are connected to a liquid supply apparatus (not shown) via conduits 112*c*, 112*c*, horizontal and vertical holes formed in a disk section of the rotary support section 112*a*, and other components.

The center gear 113 of the polishing apparatus main body 110 is positioned by a circular recess 111*f* formed in the top surface of the center of the rotary surface plate 111 and engages with the plurality of carriers 500, 500, . . . arranged on the rotary surface plate 111. A drive shaft of the center gear 113 penetrates an opening 111*g* formed in the center of the rotary surface plate 111 and a cavity 111*h* formed in the center of the rotary support member 111*a*, to project downward from the rotary support member 111*a* so as to be connected to a drive apparatus (not shown). This causes the center gear 113 to be rotationally driven independently of the lower rotary support plate 111.

The plurality of auto rotation means 114, 114, . . . are located outside the plurality of carriers 500, 500, . . . arranged on the rotary surface plate 111 and each rotation means 114 have two vertical gears 114*a* and 114*a* engaging the corresponding carrier 500. The gears 114*a* and 114*a* are rotationally driven synchronously in the same direction by means of the drive apparatus (not shown) to rotate the corresponding carrier 500 at its specified position in corporation with the center gear 113. The gears 114*a* and 114*a* also elevate and lower between an operating position where they engage with the carrier and a withdrawn position located below, to release the carrier 500 before and after polishing.

The structure of the polishing apparatus main body 110 has been described. The structures of the first work conveying section 120, the work aligning section 130, the carrier housing section 140, the carrier conveying section 150, the carrier aligning section 160, the second work conveying section 170, the brush housing section 180, and the dresser housing section 190 will be sequentially explained.

A merging mechanism for merging the work 400 with the carrier 500 outside the polishing apparatus main body 110 comprises the first work conveying section 120, the work aligning section 130, the carrier conveying section 150, and the carrier aligning section 160. The first work conveying section 120 also acts as a loading mechanism for loading the work 400 in the double side polishing apparatus 100. Additionally, the second work conveying section 170 constitutes a supply mechanism for supplying the work 400 and the carrier 500 merged together outside the polishing apparatus main body 110, onto the lower rotary surface plate 111 of the polishing apparatus main body 110, and also acts as an ejection mechanism for ejecting the work 400 polished on the lower rotary surface plate 111, to an exterior of the polishing apparatus main body 110, the work 400 remaining merged with the carrier 500.

The first work conveying section 120 also acts as a work loading mechanism that loads the work 400 in the double side polishing apparatus 100 from the conveying basket 310 stopped in the lifting mechanism 320 of the basket conveying apparatus 300 and a work conveying mechanism that conveys the work 400 from the work aligning section 130 to the carrier aligning section 160. The first work conveying section 120 comprises a suction arm 121 that sucks the work 400 in the horizontal direction from above using a bottom surface of its tip and a drive mechanism 122 composed of an articulated robot that drives the suction arm 121 in the horizontal and vertical directions, as shown in FIGS. 6 and 7.

Figure 6:
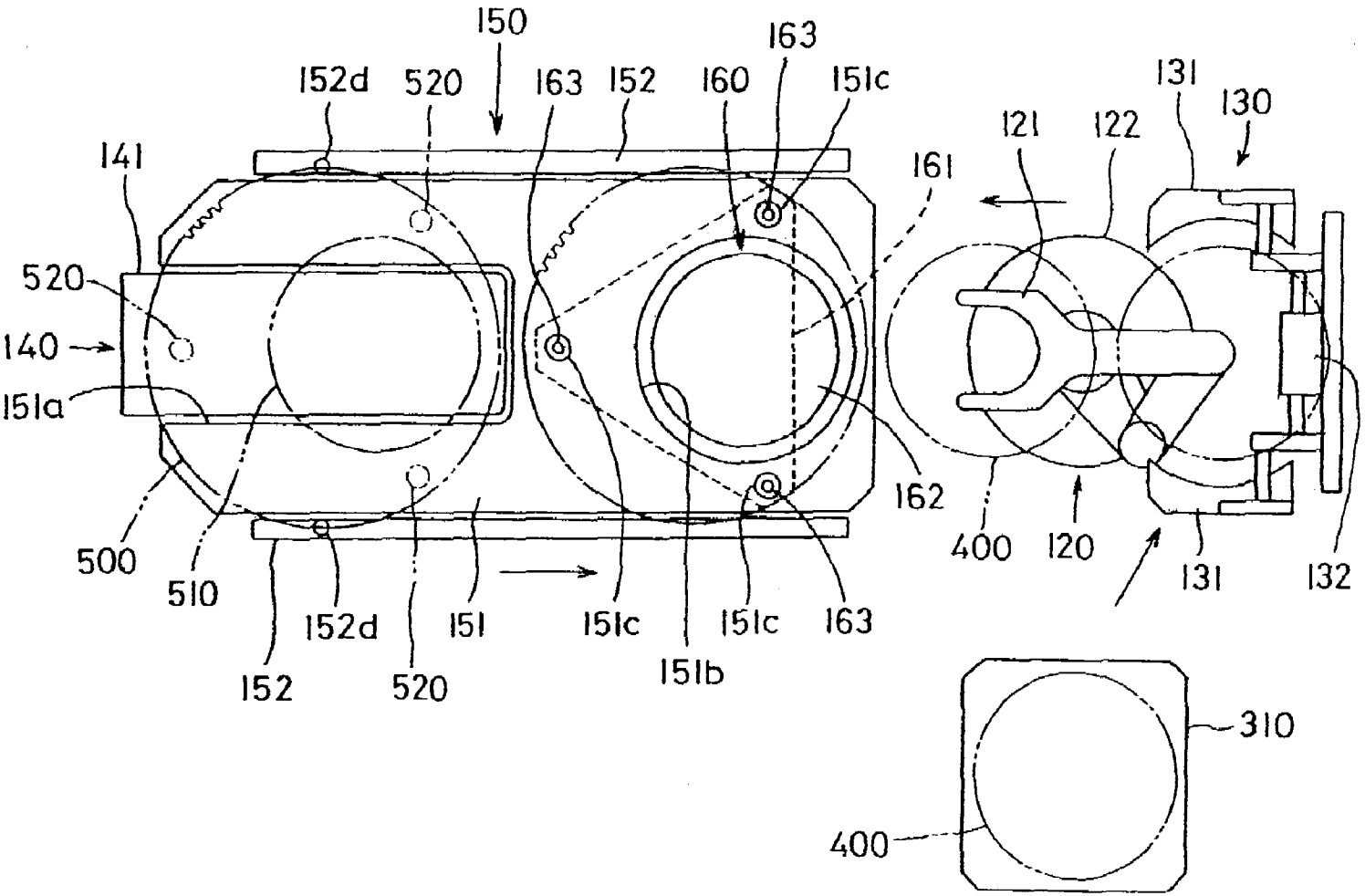
FIG. 6 is a top view of a merging mechanism for merging works and carriers together.
Figure 7:
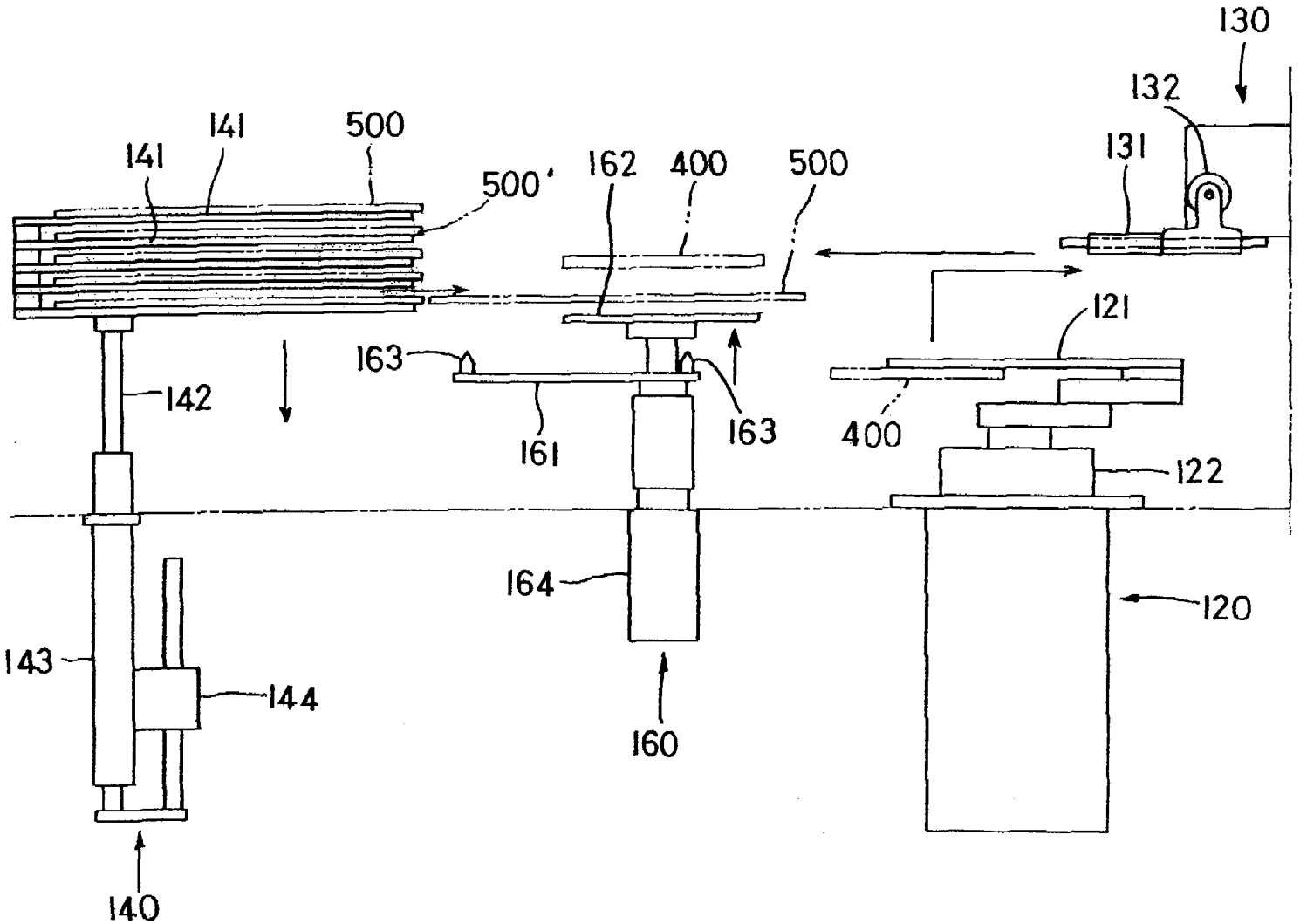
FIG. 7 is a side view of the merging mechanism.

The work aligning section 130 comprises a pair of gripping members 131 and 131 that clamp the work 400 from both sides and a drive mechanism 132 that drives the gripping members 131 and 131 in such a manner that they contact with or separate from each other, as shown in FIGS. 6 and 7. Opposite surfaces of the gripping members 131 and 131 comprise circular surfaces corresponding to the outer circumferential surface of the work 400.

The first work conveying section 120 picks up the work 400 from the conveying basket 310 stopped in the lifting mechanism 320 of the basket conveying apparatus 300 and places it on a table (not shown) of the work aligning section 130. The work 400 placed on the table is located between the gripping members 131 and 131, which are separate from each other. In this state, the gripping members 131 and 131 move inward to approach each other to clamp the work 400 from both sides, thereby moving it to its specified position. The work 400 is thus positioned.

The positioned work 400 is sucked by the first work conveying section 120 again and then conveyed to the carrier aligning section 160, described later.

As shown in FIGS. 6 and 7, the carrier housing section 140 comprises a plurality of support plates 141, 141, . . . arranged like a plurality of steps to support the plurality of carriers 500, 500, . . . in such a manner that they overlap one another at predetermined intervals in the vertical direction. A support shaft 142 that supports the support plates 141, 141, . . . is supported by a vertically fixed guide sleeve 143 so as to move in an axial direction thereof and is driven in the axial direction by a ball screw type drive mechanism 144 attached to the guide sleeve 143. Thus, the support plates 141, 141, . . . intermittently lower from their upper limit positions to sequentially place the carriers 500, 500, . . . on a support table 151 of the carrier conveying section 150, described later. For this placement, each support plate 141 supports the carrier 500 in such a manner that a part thereof extends to both sides.

The carrier conveying section 150 conveys the carrier 500 from the carrier housing section 140 to the carrier aligning section 160. The carrier conveying section 150 comprises a support table 151 that supports the carrier 500 in the horizontal direction and a pair of conveying mechanisms 152 and 152 provided at opposite sides of the support table 151, as shown in FIG. 6.

The support table 151 has a notch 151*a* at its end with the carrier housing section 140, the notch 151*a* allowing the support plates 141, 141, . . . of the carrier housing section 140 to pass therethrough. The support table 151 has at its end with the carrier aligning section 160, a large-diameter opening 151*b* through which a receiving table 162 of the carrier aligning section 160, described later passes through and a plurality of small-diameter openings 151*c*, 151*c*, . . . through which a plurality of positioning pins 163, 163, . . . pass through.

Figure 8:
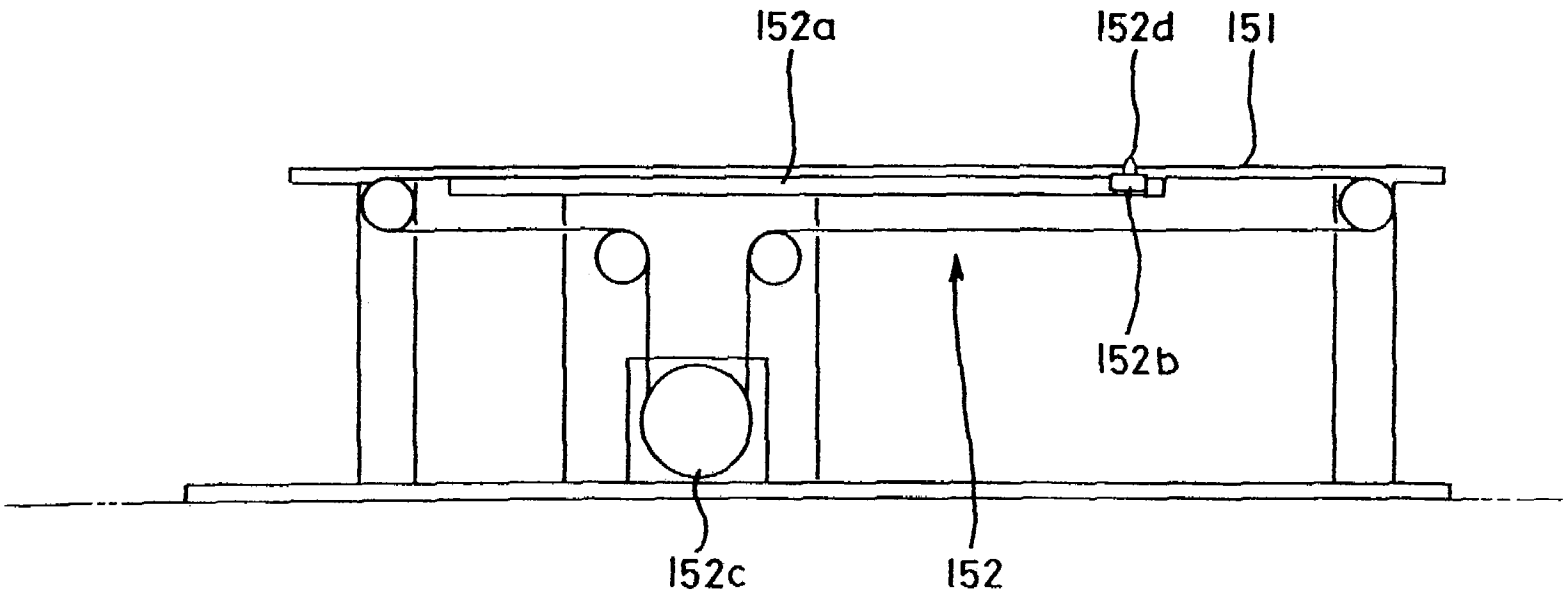
FIG. 8 is a side view of a carrier conveying mechanism in the merging mechanism.

The conveying mechanism 152 on each side comprises a horizontal guide rail 152*a* attached to a corresponding side of the support table 151, a slider 152*b* supported on the guide rail 152*a* so as to move freely, and a drive mechanism 152*c* that drives the slider 152*b*, as shown in FIG. 8. The drive mechanism 152*c* uses a motor to drive a belt to drive the slider 152*b* connected to the belt, straight along the guide rail 152*a*. The slider 152*b* has a pin-shaped engagement section 152*d* projecting upward. The engagement section 152*d* engages with sides of outer circumferential teeth of the carrier 500 placed on the support table 151.

That is, when the sliders 152*b* and 152*b* of the opposite conveying mechanisms 152 and 152 are located at one end of the support table 151 on opposite sides thereof and when the carrier 500 from the carrier housing section 140 is placed on this end of the support table 151, the engagement sections 152*d* and 152*d* of the slides 152*b* and 152*b* engage with opposite sides of the outer circumferential teeth of the carrier 500. In this state, the sliders 152*b* and 152*b* move synchronously to the other end of the support table 151 on the opposite sides thereof to convey the carrier 500 to this end and thus to the carrier aligning section 160.

The carrier aligning section 160, combined with the other end of the support table 151, comprises a lifting plate 161 for positioning the carrier 500 and a circular receiving table 162 on which the work 400 is placed, as shown in FIGS. 6 and 7. The lifting plate 161 has a plurality of positioning pins 163, 163, . . . projecting upward. The receiving table 162 is located above the lifting plate 161 and is driven to elevate and lower with the lifting plate 161 by means of a drive mechanism 164 located below.

That is, the carrier aligning section 160 has an initial position where a top surface of the receiving table 162 located above is flush with a top surface of the support table 151 of the carrier conveying section 150. Accordingly, at this initial position, the plurality of positioning pins 163, 163, . . . are located below the support table 151. In this state, when the carrier 500 is conveyed onto the other end of the support table 151, an accommodation hole 510 in the carrier 500 aligns with the large-diameter opening 151*b* in the support table 151. After the carrier 500 has been conveyed, the lifting plate 161 and the receiving table 162 elevate. This elevation causes the plurality of positioning pins 163, 163, . . . to pass through the small-diameter openings 151*c*, 151*c*, . . . formed in the other end of the support table 151 and then to be inserted from below through a plurality of small-diameter holes 520, 520, . . . for positioning formed in the carrier 500 on the other end. This causes the carrier 500 to be located at the other end of the support table 151.

At this point, the receiving table 162 elevates through the large-diameter opening 151*b* in the support table 151 and the accommodation hole 510 in the carrier 500 to above the carrier 500. The work 400 aligned by the work aligning section 130 is sucked, conveyed, and then placed on the lifted receiving table 162 by means of the first work conveying section 120. After the placement, the lifting plate 161 and the receiving table 162 lower down to the initial positions. This causes the work 400 on the receiving table 162 to be inserted into the accommodation hole 510 in the carrier 500 positioned on the other end of the support table 151, so that the work 400 is combined with the carrier 500 into a separable merged state.

Figure 9:
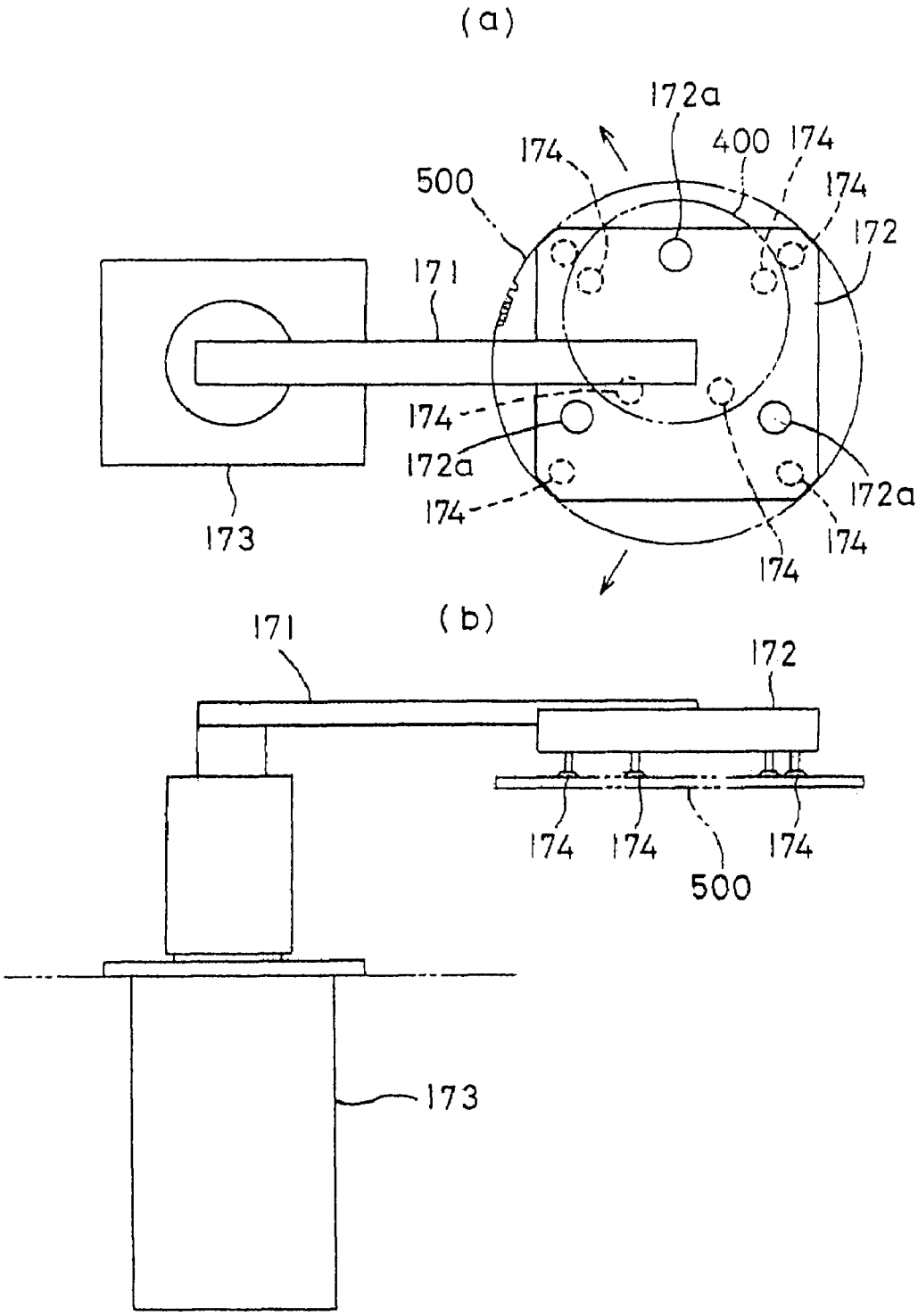
FIG. 9 is a top view and a side view of a supply mechanism for supplying works to the lower surface plate.

The second work conveying section 170 of the double side polishing apparatus 100 conveys the merged work 400 and carrier 500 to the polishing apparatus main body 110. The second work conveying section 170 comprises a suction head 172 attached to a horizontal arm 171 and a drive mechanism 173 that rotates the arm 171 around its base within a horizontal plane while lifting and lowering it in the vertical direction, as shown in FIG. 9.

The suction head 172 includes a plurality of suction pads 174, 174, . . . on its bottom surface to hold the merged work 400 and carrier 500 thereunder in the horizontal direction. A combination of this suction with the swinging, ascent, and descent of the suction head 172 associated with the rotation, ascent, and descent of the arm 171 causes the work 400 and the carrier 500 merged together in the carrier aligning section 160 to be conveyed onto the lower rotary surface plate 111 of the polishing apparatus main body 110. The suction head 172 has a plurality of escape holes 172*a*, 172*a*, . . . to avoid interference with a plurality of support pins 193, 193, . . . on the dresser housing section 190, described later.

Figure 10:
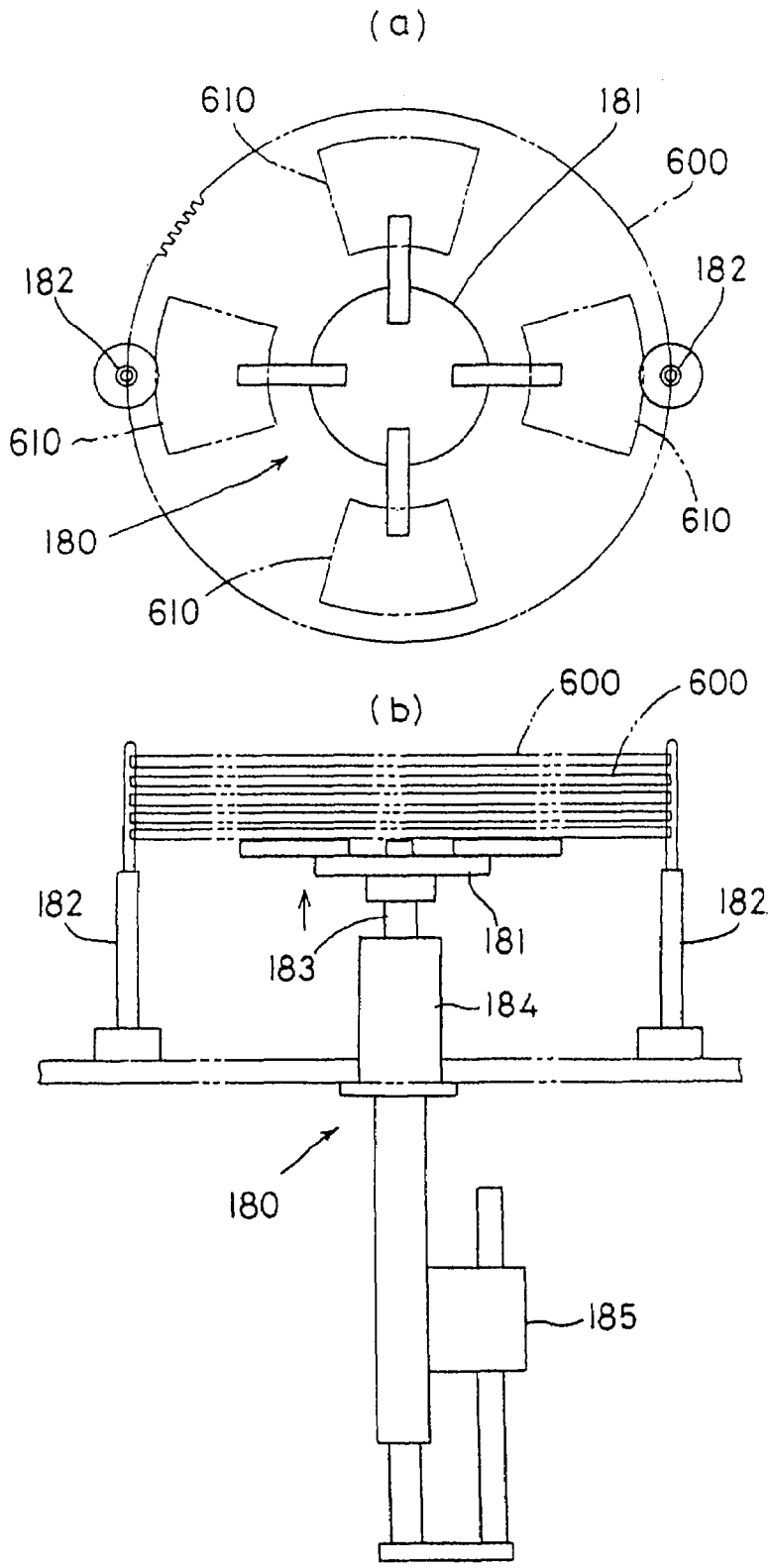
FIG. 10 is a top view and a side view of a brush housing section.
Figure 11:
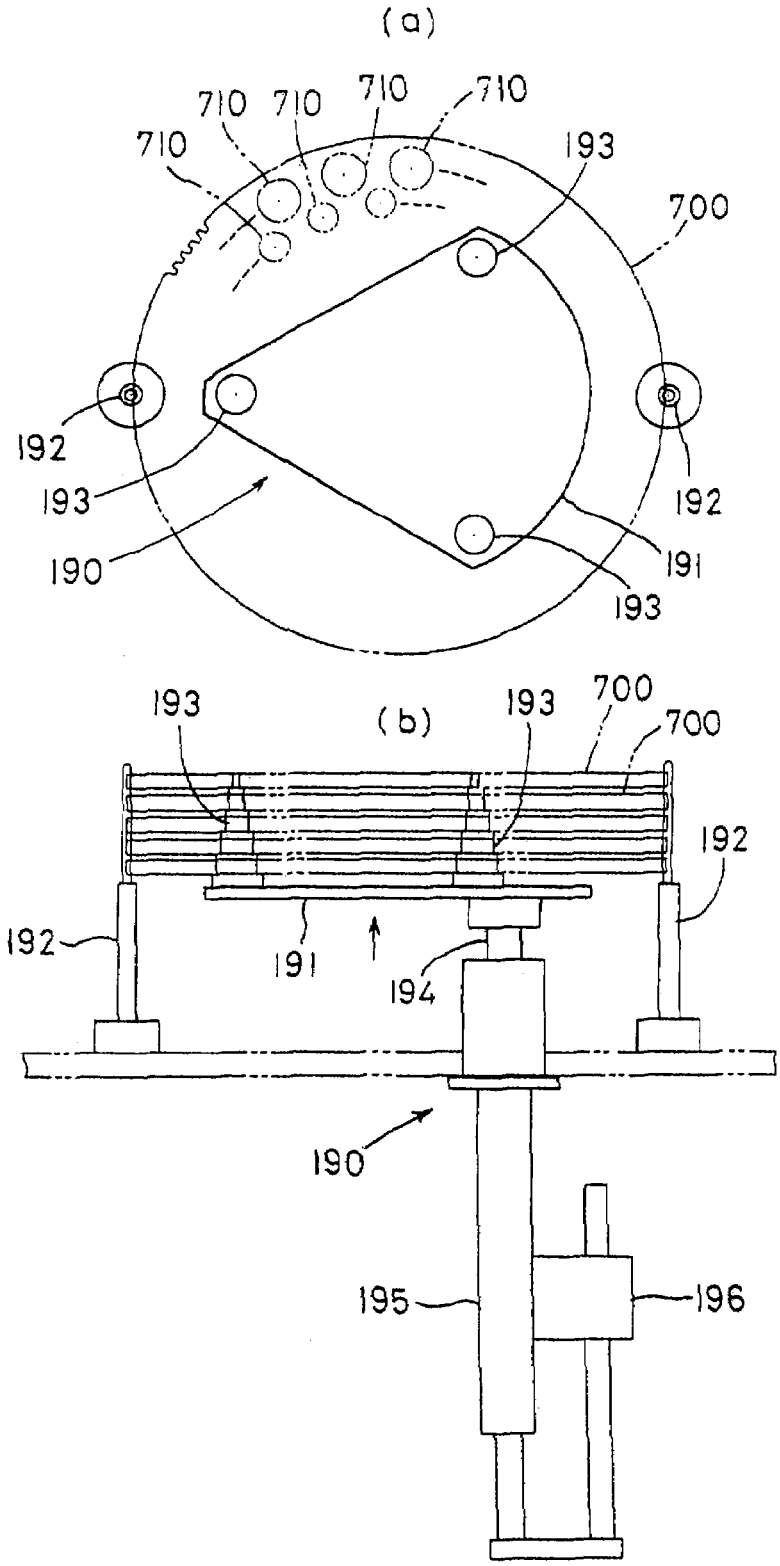
FIG. 11 is a top view and a side view of a dresser housing section.

The brush housing section 180 comprises a support table 181 that supports a plurality of brushes 600, 600, . . . in such a manner that they overlap one another in their thickness direction, and a plurality of holding members 182 and 182 that hold the brushes 600, 600, . . . on the support table 181, as shown in FIG. 10. A support shaft 183 that supports the support table 181 is supported by a guided sleeve 184 vertically fixed so as to move in an axial direction of the support shaft and is driven in the same direction by a ball screw type mechanism 185 attached to the guide sleeve 184.

Each brush 600 is an external gear shaped to correspond to the carrier 500 and used to clean polishing cloths installed on opposite surfaces of the rotary surface plates 111 and 112. For this cleaning, a plurality of brush sections 610, 610, . . . are provided on each of the top and bottom surfaces of the brush 600. The brush section 610, 610, . . . are distributed so as to suck and convey the brush 600. The brush section 610, 610, . . . on the top surface and the bush section on the bottom surface are displaced to each other in a circumferential direction of the brush so as to interfere with each other when stacked up. The holding members 182 and 182 engage with outer circumferential teeth of the brushes 600, 600, . . . on the support table 181 to hold the brushes 600, 600, . . . .

The dresser housing section 190 comprises a support table 191 that supports a plurality of dressers 700, 700, . . . by laminating them in their thickness direction, and a plurality of holding members 192 and 192 that hold the dressers 700, 700, . . . on the support table 191. To support the dressers 700, 700, . . . at intervals in their thickness direction, the support table 191 supports the dressers 700, 700, . . . using a plurality of support pins 193, 193, . . . having corresponding outer diameters increasing stepwise from the highest support pin to the lowest support pin. A support shaft 194 that supports the support table 191 is supported by a guided sleeve 195 vertically fixed so as to move in an axial direction of the support shaft and is driven in the same direction by a ball screw type mechanism 196 attached to the guide sleeve 195.

Each dresser 700 is an external gear shaped to correspond to the carrier 500. The dresser 700 has grinding sections 710, 710, . . . attached to each of the top and bottom surfaces of an outer circumferential portion of the dresser 700 in order to level the surfaces of the polishing clothes installed on the opposite surfaces of the rotary surface plates 111 and 112, the grinding sections 710, 710, . . . comprising a large number of diamond pallets or the like. Since the grinding sections 710, 710, . . . are provided only in the outer circumferential portion of the dresser 700, the dresser 700 can also be sucked and conveyed.

The second work conveying section 170 that sucks and conveys the work 400 and the carrier 500 merged together by the carrier aligning section 160 also acts as a conveying section that sucks and conveys the brush 600 and the dresser 700 to the polishing apparatus main body 110. Thus, the brush housing section 180 and the dresser housing section 190 are arranged immediately below a swinging arc of the suction head 172 of the second work conveying section 170.

Next, an automated double side polishing operation for silicon wafers using the above described double side polishing facility will be described.

The double side polishing apparatus 100 loads a plurality of works 400, 400, . . . in the first work conveying section 120 from the conveying basket 310 stopped in the lifting mechanism 320 of the basket conveying apparatus 300. Specifically, the suction arm 121 of the first work conveying section 120 sequentially sucks from the top the works 400, 400, . . . from the conveying basket 310 and places them on a table (not shown) of the work aligning section 130. Each time one of the works 400, 400, . . . is picked up, the conveying basket 310 is driven upward one pitch by means of the lifting mechanism 320.

When the work 400 is placed on the table (not shown) of the work aligning section 130, the gripping members 131, 131 approach. Thereby, the work 400 is located at the prescribed position.

In parallel with the loading of the works 400, 400, . . . from the conveying basket 310, the carrier conveying section 150 conveys the carriers 500, 500, . . . from the carrier housing section 140, from one end to the other end of the support table 151 and then to the carrier aligning section 160. The carrier 500 transferred to the carrier aligning section 160 is placed at a predetermined position when the lifting plate 161 and the receiving table 162 elevate to lift the plurality of positioning pins 163, 163, . . . .

When the lifting plate 161 and the receiving table 162 elevate, the suction arm 121 of the first work conveying section 120 conveys the work 400 from the work aligning section 130 to the receiving table 162. In this case, since the suction arm 121 of the first work conveying section 120 simply sucks, from above, the work 400 aligned by the work aligning section 130 and conveys it to the receiving table 162, the work 400 is placed at the predetermined position at the work aligning section 130 even on the receiving table 162 and thus accurately positioned relative to the accommodation hole 510 in the positioned carrier 500 located below.

Then, the lifting plate 161 and the receiving table 162 lower down to their initial positions to reliably insert the work 400 into the accommodation hole 510 in the carrier 500.

The work 400 and the carrier 500 thus positioned outside the polishing apparatus main body 110 are combined together into a separable merged state also outside the main body 110 and are thus reliably merged together. This eliminates the needs for monitoring or corrections by the operator and allows the work 400 to be conveyed to the work aligning section 130 by the simple first work conveying section 120, which is of the sucking type, thereby obviating a complicated guide mechanism or the like in the first work conveying section 120 to simplify the configuration of the apparatus.

Once the work aligning section 130 completes merging the work 400 and the carrier 500 together, the work 400 and the carrier 500 are conveyed to their specified position on the lower rotary surface plate 111 of the polishing apparatus main body 110 while remaining merged together. At this point, in the polishing apparatus main body 110, the upper rotary surface plate 112 has been lifted and the plurality of rotation means 114, 114, . . . have been lowered.

The plurality of works 400, 400, . . . are supplied onto the lower rotary surface plate 111 by repeating the operation of conveying the work 400 and the carrier 500 to their specified position on the lower rotary surface plate 111 while performing an indexing operation of rotating the rotary surface plate 111 through a predetermined angle for each conveying operation. The second work conveying section 170, which sequentially conveys the works 400 and the carriers 500 to their specified positions on the rotary surface plate 111, has a simpler structure and a higher conveying accuracy than one that distributes them to a plurality of positions on the rotary surface plate 111. In this case, since the plurality of auto rotation means 114, 114, . . . have lowered, they do not engage with the carriers 500, 500, . . . on the rotary surface plate 111. On the other hand, the center gear 113 engages with the carriers 500, 500, . . . on the rotary surface plate 111 but is driven synchronously with rotation of the rotary surface plate 111 so that the carriers 500, 500, . . . on the rotary surface plate 111 will not move relative to the rotary surface plate 111. This prevents the works 400, 400, . . . supplied on the lower rotary surface plate 111 from moving unintentionally due to the indexing operation for the rotary surface plate 111.

Once all the works 400 and carriers 500 have been conveyed onto the lower rotary surface plate 111, the plurality of auto rotation means 114, 114, . . . elevate up to their specified positions while the upper rotary surface plate 112 lowers. This causes the plurality of works 400, 400, . . . on the rotary surface plate 111 to be sandwiched between the polishing clothes of the upper and lower rotary surface plates. In this state, a grinding liquid is supplied between the rotary surface plates 111 and 112, which are then rotated in opposite directions. Additionally, the center gear 113 and auto rotation means 114, 114, . . . , engaging with the carriers 500, 500, . . . , are rotationally driven synchronously. The carriers 500, 500, . . . thereby continue rotating between the rotary surface plates 111 and 112, while the works 400, 400, . . . held on the carriers 500, 500, . . . make an eccentric rotational motion. This causes both surfaces of each work 400 to be polished.

The polishing apparatus main body 110, which rotates the carriers 500, 500, . . . between the rotary surface plates 111 and 112 at their specified positions, eliminates the needs for a large internal gear compared to the conventional planetary gear method involving revolutions, thereby reducing the apparatus price while maintaining a high polishing accuracy. In addition, since the auto rotation means 114, 114, . . . can elevate and lower, the operation of indexing the rotary surface plate 111 while supplying the works 400, 400, . . . can be performed simply by rotating the rotary surface plate 111 and the center gear 113. If the center gear 113 can elevate and lower similarly to the auto rotation means 114, 114, . . . , the indexing operation can be performed by rotating only the rotary surface plate 111.

Once all the works 400, 400, . . . have been subjected to the double side polishing, the upper and lower rotary surface plates 111 and 112 are stopped at their home positions. After the stoppage, the plurality of nozzles 112*b*, 112*b*, . . . provided in the upper rotary surface plate 112 inject a fluid such as water, while the rotary surface plate 112 is lifted. Additionally, the plurality of nozzles 111*b*, 111*b*, . . . provided in the lower rotary surface plate 111 start a sucking operation.

Since at this point, the upper and lower rotary surface plates are stopped at their home positions, the nozzles 112*b*, 112*b*, . . . are opposite to the top surfaces of the works 400, 400, . . . , while the nozzles 111*b*, 111*b*, . . . are opposite to the top surfaces of the works 400, 400, . . . . Thus, the works 400, 400, . . . are both pressed by the liquid injection from above and sucked downward so as to be reliably held on the lower rotary surface plate 111 with the liquid collected thereon when the upper rotary surface plate 112 is lifted. Consequently, the works 400, 400, . . . are prevented from drying. Moreover, force for holding the works comprises the pressing force from above and the downward sucking force, which are both effected by fluid pressures, thereby precluding the works 400, 400, . . . from being damaged.

The downward suction by the plurality of nozzles 111*b*, 111*b*, . . . provided in the lower rotary surface plate 111 lasts only a short time in order to preclude the works 400, 400, . . . from drying and the suction may be omitted. Despite the omission of the downward suction by the nozzles 111*b*, 111*b*, . . . , the downward pressure of the fluid from the nozzles 112*b*, 112*b*, . . . is so strong that there is substantially no possibility that the works 400, 400, . . . transfer toward the upper rotary surface plate 112.

Once the upper rotary surface plate 112 has elevated up to its specified position, the second work conveying section 170 conveys the works 400, 400, . . . from the lower rotary surface plate 111 to the work aligning section 130, the works 400, 400, . . . remaining merged with the carriers 500, 500, . . . . During this ejection, the indexing operation is performed to rotate the lower rotary surface plate 111 through the predetermined angle.

The works 400 and the carriers 500 conveyed to the work aligning section 130 are separated from each other by means of an operation reverse to the merging operation by this work aligning section 130. The work 400 separated from the carrier 500 is accommodated in the conveying basket 310 by the first work conveying section 120, whereas the carrier 500, remaining in the work aligning section 130, is accommodated in the carrier housing section 140 by the carrier conveying section 150.

In this manner, after the double side polishing, the works 400, 400, . . . are ejected to an exterior of the double side polishing apparatus 100 using the second work conveying section 170, work aligning section 130, and first work conveying section 120, which are used to supply the works. The works are then conveyed to the loader unloader apparatus 200 by the conveying basket 310.

Once one double side polishing operation has been completed, the plurality of brushes 600, 600, . . . housed in the brush housing section 180 are sequentially conveyed to the lower rotary surface plate 111 by the second work conveying section 170 before the next double side polishing is started. This conveyance is similar to that of the works 400 and the carriers 500 and the rotary surface plate 111 performs the indexing operation. Additionally, the support table 181 of the brush housing section 180 elevates one pitch each time the brush 600 is to be unloaded, to move the top brush 600 to an unloading position.

When all the brushes 600, 600, . . . have been conveyed onto the lower rotary surface plate 111, the upper rotary surface plate 112 is lowered to sandwich the brushes 600, 600, . . . between the upper and lower polishing clothes. In this state, the rotary surface plates 111 and 112 are rotated in the opposite directions, while the center gear 113 and auto rotation means 114, 114, . . . , engaging with the brushes 600, 600, . . . , are rotationally driven synchronously. This causes the upper and lower polishing clothes to be cleaned by the brushes 600, 600, . . . .

Once the upper and lower polishing clothes have been cleaned, the upper rotary surface plate 112 is lifted and the second work conveying section 170 conveys the brushes 600, 600, . . . from the lower rotary surface plate 111 to the brush housing section 180. While the brushes are thus being ejected, the indexing operation is performed to rotate the lower rotary surface plate 111 through the predetermined angle.

When all the brushes 600, 600, . . . have been ejected, double side polishing of the next works 400, 400, . . . is started.

When the double side polishing operation has been completed several times, the plurality of dressers 700, 700, housed in the dresser housing section 180 (190?) are sequentially conveyed to the lower rotary surface plate 111 by the second work conveying section 170 before the next double side polishing is started. This conveyance is similar to that of the brushes 600, the rotary surface plate 111 performs the indexing operation, and the support table 191 of the dresser housing section 190 elevates one pitch each time the dresser 700 is to be unloaded, to move the top dresser 700 to an unloading position.

When all the dressers 700, 700, . . . have been conveyed onto the lower rotary surface plate 111, the upper rotary surface plate 112 is lowered to sandwich the dressers 700, 700, . . . between the upper and lower polishing clothes. In this state, the rotary surface plates 111 and 112 are rotated in the opposite directions, while the center gear 113 and auto rotation means 114, 114, . . . , engaging with the dressers 700, 700, . . . , are rotationally driven synchronously. This causes the dressers 700, 700, . . . to level the surfaces of the upper and lower polishing clothes.

Once the dressers 700, 700, . . . have leveled the surfaces of the upper and lower polishing clothes, the upper rotary surface plate 112 is lifted and the second work conveying section 170 conveys the dressers 700, 700, . . . from the lower rotary surface plate 111 to the dressers housing section 180. While the dressers are thus being ejected, the indexing operation is performed to rotate the lower rotary surface plate 111 through the predetermined angle.

When all the dressers 700, 700, . . . have been ejected, double side polishing of the next works 400, 400, . . . is started.

As described above, the double side polishing apparatus 100 comprises the second work conveying section 170 that conveys the brush housing section 180 housing the brushes 600, 600, . . . as well as the brushes 600, 600, . . . , onto the lower rotary surface plate 111 to automatically brush the polishing clothes. Accordingly, the brushing can frequently be executed, for example, for each polishing operation. Consequently, polishing quality can be improved. Moreover, the second work conveying section 170 that conveys the brush housing section 180 housing the brushes 600, 600 . . . onto the lower rotary surface plate 111 also conveys the works 400, 400, . . . onto the rotary surface plate 111, and makes these conveyances serve a double purpose thereby simplifying the apparatus configuration.

Additionally, the double side polishing apparatus 100 comprises the second work conveying section 170 that conveys the dresser housing section 190 housing the dressers 700, 700, . . . as well as the dressers 700, 700, . . . , onto the lower rotary surface plate 111 to automatically dress the polishing clothes. Accordingly, the polishing can frequently be executed, for example, for each polishing operation. Consequently, polishing quality can be improved. Moreover, the second work conveying section 170 that conveys the dressers 700, 700 . . . also conveys the works 400, 400, . . . onto the rotary surface plate 111 and makes these conveyances serve a double purpose, thereby simplifying the apparatus configuration.

In the above embodiment, the double side polishing apparatus 100 polishes silicon wafers, but it is also applicable to their lapping or to polishing or lapping of works other than silicon wafers.

Next, a preferred embodiment of the polishing apparatus main body of the double side polishing apparatus 100 will be described with reference to FIGS. 12 to 14.

A polishing apparatus main body 800 according to this embodiment is the polishing apparatus main body 110 used in the above described double side polishing apparatus 100. The double side polishing apparatus 800 comprises a lower frame 810 and an upper frame 820 provided above as shown in FIGS. 12 and 13. The lower frame 810 has a lower rotary surface plate 830 attached thereto, and the upper frame 820 has an upper rotary surface plate 840 concentrically attached thereto and located above the lower rotary surface plate 830.

The lower rotary surface plate 830 is screwed onto a rotary support shaft 831 having a cavity in its center. The rotary support shaft 831 is rotatably attached to the lower frame 810 via a plurality of bearings and is rotationally driven by a motor 832 to rotate the rotary surface plate 830. That is, an output shaft of the motor 832 is connected to a speed reducer 833 and a gear 834 attached to an output shaft of the speed reducer 833 engages with a gear 835 attached to the rotary support shaft 831, to rotate the rotary support shaft 831 and thus the rotary surface plate 830. The rotary surface plate 830 has a polishing pad 839 stuck to its top surface.

The rotary surface plate 830 has a center gear 850 supported in its center via a plurality of bearings so as to rotate independently of the rotary surface plate 830. The center gear 850 is rotationally driven independently of the rotary surface plate 830 by means of a rotational drive shaft 851 penetrating a cavity formed in the center of the rotary support shaft 831. That is, a pulley 852 attached to a lower end of the rotational drive shaft 851 and a pulley 885 attached to an output shaft of a speed reducer 881, described later, are connected together via a belt 886 to rotate the rotational drive shaft 851 while rotationally driving the center gear 850 independently of the rotary surface plate 830.

A plurality of rotation means 860, 860, . . . are disposed around the rotary surface plate 830 in a circumferential direction thereof at equal intervals. The plurality of rotation means 860, 860, . . . cooperate with the center gear 850 in rotationally driving a plurality of carriers 870, 870, . . . at their specified positions, the carriers being placed on the rotary surface plate 830. The carriers 870 each have a work accommodating hole 871 to accommodate wafer 890 eccentrically to its center, and a tooth section 872 on its outer circumferential surface which engages with the center gear 850.

The rotation means 860 each have a pair of rotary gears 861 and 861 engaging with a tooth section 872 of the corresponding carrier 870, symmetrically from the exterior. The rotary gears 861 and 861 are spur gears shaped like bars elongate in the direction of their rotation axis and are configured by laminating a plurality of thin spur gears of a resin in the rotation axis direction. The rotary gears 861 and 861 are rotatably attached to the lower frame 810 so as to elevate and lower. That is, the lower frame 810 has two guide sleeves 862 and 862 vertically attached thereto. The guide sleeves 862 each have a shaft 863 movably penetrating an interior thereof in both circumferential and axial directions thereof, and have the rotary gear 861 attached to an upper end thereof. The shaft 863 has a pulley 865 spline-connected to its lower end.

The pair of shafts 863 and 863 are driven in a vertical direction of the apparatus by means of a cylinder 867 attached to the lower frame 810 to act as a lifting device. The rotary gears 861 and 861 of the rotation means 860 are driven so as to elevate and lower in their axial direction with the pulleys 865 and 865 remaining at their specified positions. Additionally, when the pulleys 865 and 865 are rotationally driven by a drive mechanism, described later, the rotary gears 861 and 861 rotate synchronously in the same direction.

Figure 12:
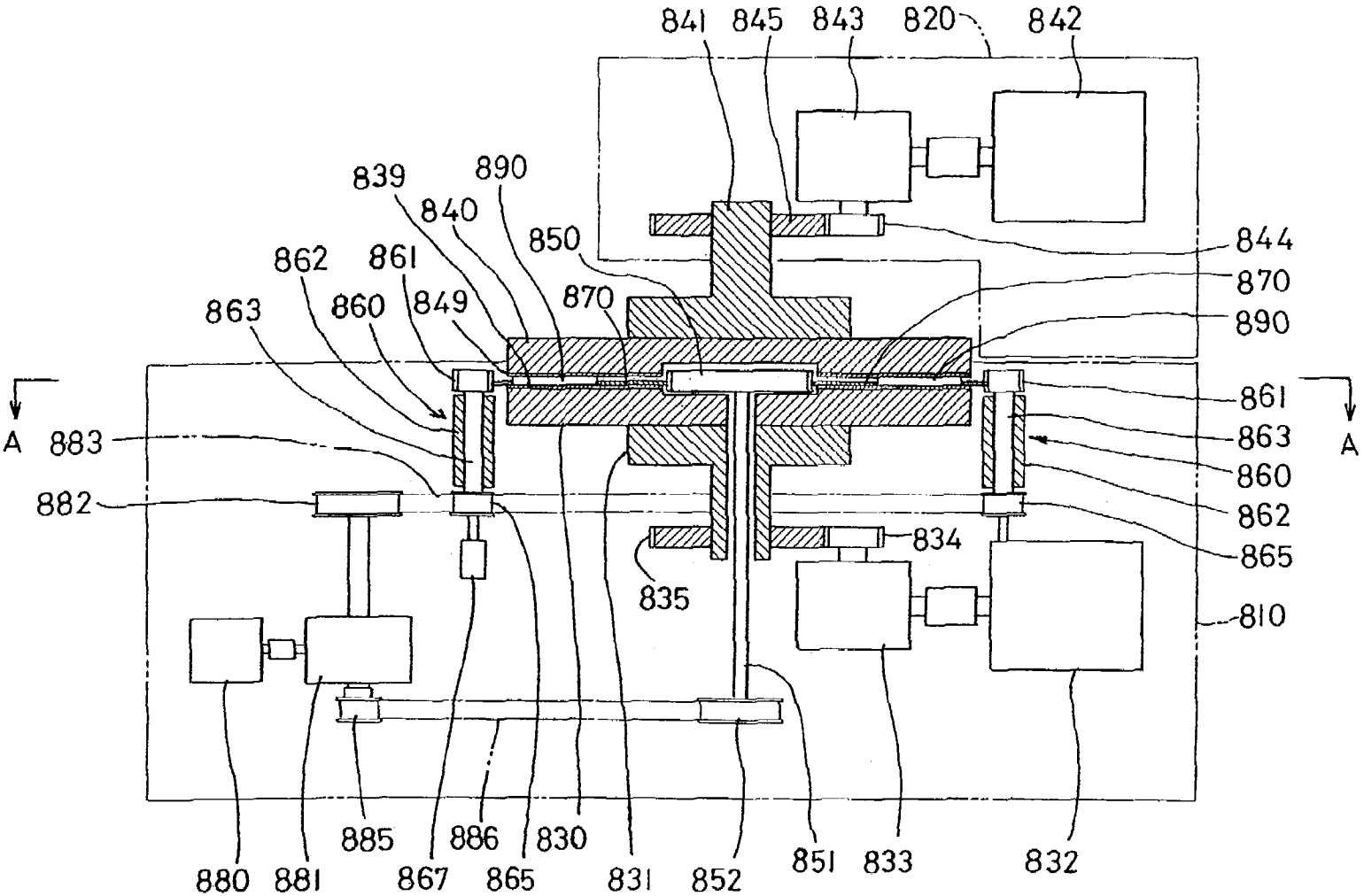
FIG. 12 is a vertical sectional view of one embodiment of a polishing apparatus main body, principally showing a carrier driving mechanism.
Figure 13:
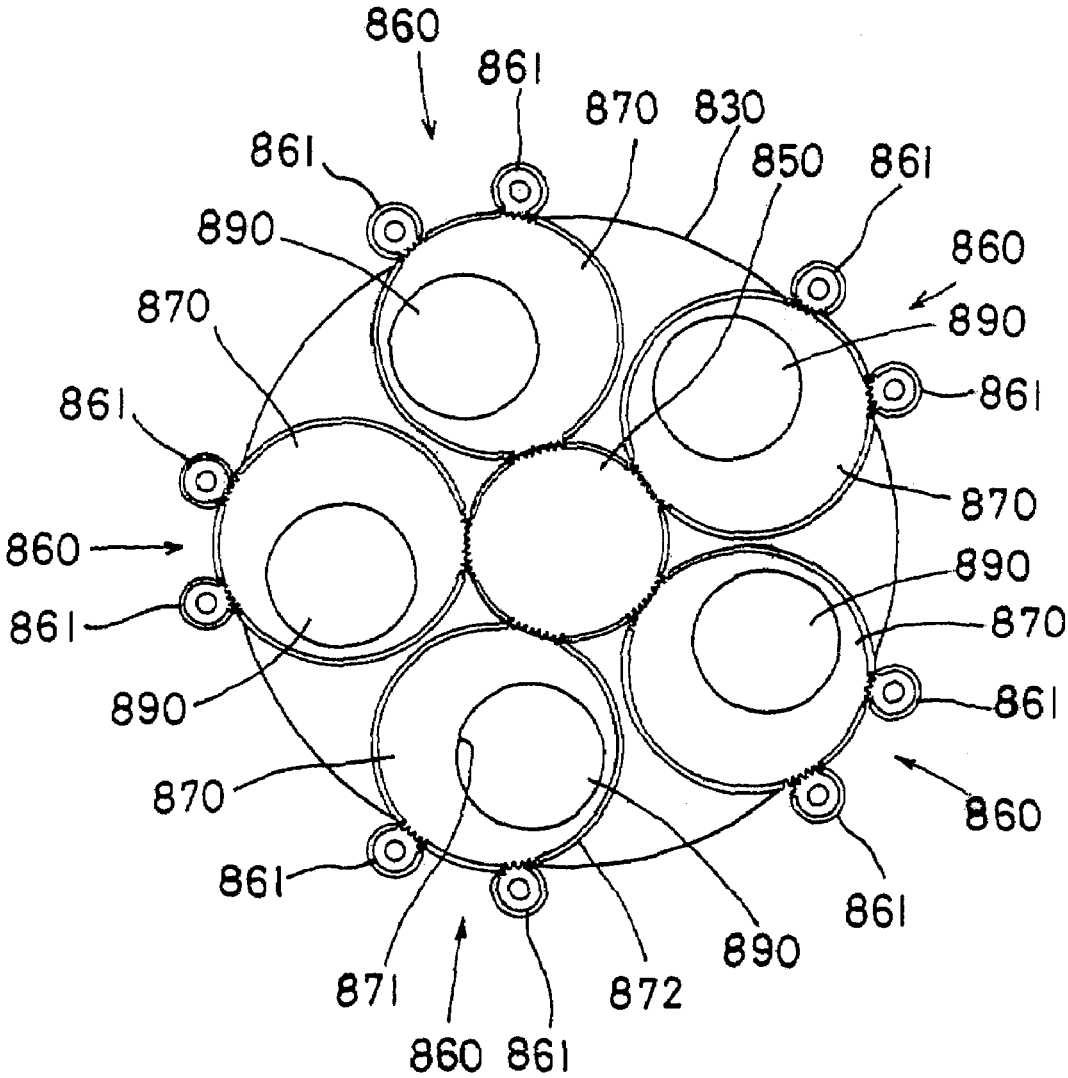
FIG. 13 is a view taken along a line A-A in FIG. 12.
Figure 14:
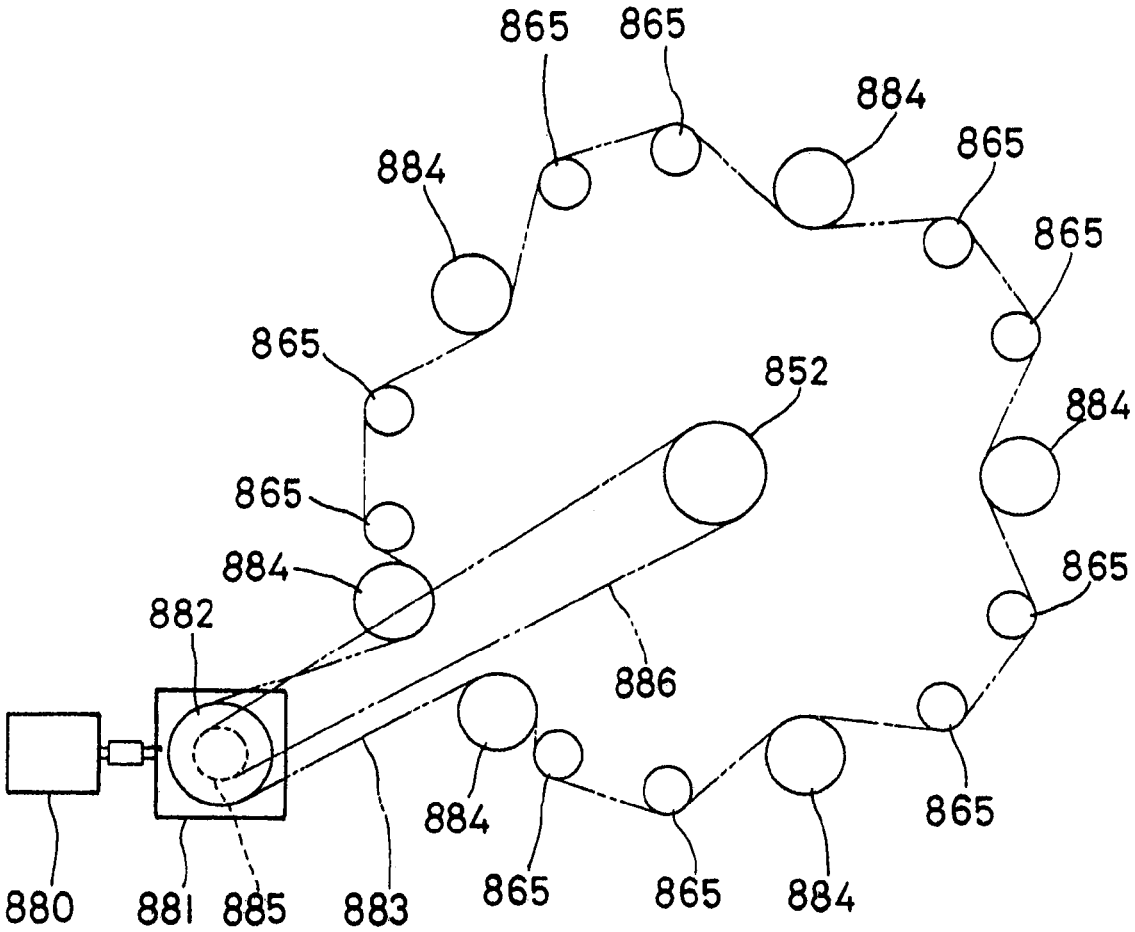
FIG. 14 is a top view of a power transmission system for driving the carriers.

A rotational drive mechanism for the rotation means 860 use a motor 880 attached to the lower frame 810 as shown in FIGS. 12 to 14. The motor 880 has an output shaft connected to a speed reducer 881. The speed reducer 881 has output shafts projecting upward and downward, and the upper output shaft has a pulley 882 attached thereto. A belt 883 is set across the pulley 882 and each of the pulleys 865, 865, . . . of the plurality of rotation means 860, 860, . . . disposed around the rotary surface plate 830. Accordingly, when the motor 880 is operated, the rotary gears 861 and 861 of the plurality of rotation means 860, 860, . . . disposed around the rotary surface plate 830 rotate synchronously in the same direction. Reference numeral 884 denotes an idle roller for tensioning provided between the adjacent rotation means 860 and 860.

On the other hand, a pulley 885 is attached to the lower output shaft of the speed reducer 881. The pulley 885 is connected to the pulley 852 attached to the lower end of the rotational drive shaft 851 of the center gear 850 via a belt 886 as described above. Accordingly, as the motor 880 operates, the center gear 850 rotates. The rotational and circumferential directions of the center gear 850 are set the same as those of the rotary gears 861 and 861 of the plurality of rotation means 860, 860, . . . .

The upper rotary surface plate 840 is concentrically provided on the lower rotary surface plate 830 as shown in FIG. 12. The rotary surface plate 840 has a polishing pad 849 stuck to its bottom surface.

The rotary surface plate 840 is connected to a lower end of a vertical support shaft 841. The support shaft 841 is rotatably supported in the upper frame 820 via a plurality of bearings, and rotation of a motor 842 also provided in the upper frame 820 is transmitted to the support shaft 841 via gears 844 and 845 to rotationally drive the rotary surface plate 840 independently of the lower rotary surface plate 830. In addition, a lifting device (not shown) drives the rotary surface plate 840 so as to elevate and lower within the upper frame 820 in the rotation axis direction together with the motor 842 and a speed reducer 843.

The configuration of the polishing apparatus main body 800 has been described. The use and operation of this polishing apparatus main body 800 will be explained.

After the upper rotary surface plate 840 has been lifted and the rotary gears 861 and 861 of the rotation means 860 have been lowered from their specified positions, plurality of carriers 870, 870, . . . are set on the lower rotary surface plate 830. The rotary gears 861 and 861 in such a manner that the tooth section 872 of each of the set carriers 870 is internally engaged with the center gear 850 and externally symmetrically with the rotary gears 861 and 861 of the corresponding rotation means 860. A wafer 890 is set in a work accommodating hole 871 in each carrier 870.

Once the wafers 890 have been set in the work accommodating holes 871 in the plurality of carriers 870, 870, . . . , the upper rotary surface plate 840 is lowered to sandwich the plurality of wafers 890, 890, . . . between the rotary surface plates 840 and 840 (strictly speaking, between the polishing pads 839 and 849) under a predetermined pressure. The motors 832 and 842 are then actuated to rotate the rotary surface plates 830 and 840 in opposite directions. At the same time, the motor 880 is actuated.

When the motor 880 is actuated, the center gear 850 rotates. Additionally, the pair of rotary gears 861 and 861 of the plurality of rotation means 860 and 860 disposed around the lower rotary surface plate 830 rotate. In this case, the center gear 850 engages internally with the carrier 870 located outside and the pair of rotary gears 861 and 861 engage externally with the carrier 870 at two symmetrical positions, the carrier 870 being located inside. In addition, the rotational and circumferential directions of the center gear 850 are set the same as those of the rotary gears 861 and 861. Consequently, the carriers 870, 870, . . . between the rotary surface plates 830 and 840 rotate at their specified positions in the same direction to eccentrically rotationally move the wafers 890, 890, . . . in the carriers 870, 870, . . . .

Thus, both surfaces of each of the wafers 890, 890, . . . are simultaneously polished by the polishing pads 839 and 849.

Further, during polishing, the rotary gears 861 and 861 of the rotation means 860 repeat ascents and descents in the rotation axis direction with low cycles while remaining engaged with the carriers 870.

Once the polishing has been completed, the upper rotary surface plate 840 is lifted to lower the rotary gears 861 and 861 of the rotation means 860 from their specified positions. The wafers 890, 890, . . . are then picked up from the carriers 870, 870, . . . on the rotary surface plate 830.

Such double side polishing rotates the carriers 870, 870, . . . at their specified positions in the same direction and does not revolve them around the center gear 850. Thus, no internal gear for revolution is required, thereby preventing a decrease the polishing accuracy caused by manufacturing errors in the internal gear or other factors. Therefore, a polishing accuracy equivalent to or higher than that for the conventional apparatus is obtained for larger apparatuses for carriers 870, 870, . . . of a larger diameter.

Since the internal gear that is substantially as large as the outer diameter of the surface plate is omitted and its drive mechanism is also omitted, the size of the apparatus is reduced even with the addition of the rotation means 860, 860, . . . to thereby reduce costs.

Since the rotary gears 861 and 861 of each rotation means 860 are composed of a resin, no metallic power result from engagement between the rotary gears 861 and the carrier 870. This prevents the wafers 890 from being contaminated with metallic powders. In this regard, the carriers 870 are also made of a resin. Additionally, these rotary gears require lower manufacturing costs than those of metal. There is a possibility that the rotary gears will be abraded, but since accents and descents are repeated during the polishing, local abrasion caused by the engagement between the rotary gears and the carrier 870 is restrained. Furthermore, an abraded portion can be repaired by a partial replacement, an increase in costs resulting from the abrasion is minimized. The ability to lift and lower the rotary gears 861 and 861 simplifies the operation of setting and removing the carriers 870, 870, . . . .

Moreover, in the above described embodiment, the plurality of rotation means 860, 860, . . . are driven by a common drive source (a motor 880) that is also used to drive the center gear 850, thereby enabling these components to synchronize accurately while serving to reduce their sizes.

On the other hand, the rotary surface plates 830 and 840 are driven independently of the center gear 850 and the rotation means 860, 860, . . . ; this has the advantages of being able to vary their speeds and to set various polishing conditions. Since according to the present invention, the carriers 870, 870, . . . do not revolve but make a simple motion, it is very significant that the rotary surface plates 830 and 840 are independently driven to set the various polishing conditions. Consequently, it is further advantageous to drive the rotary surface plates 830 and 840 separately by means of the motors 832 and 842.

Figure 15:
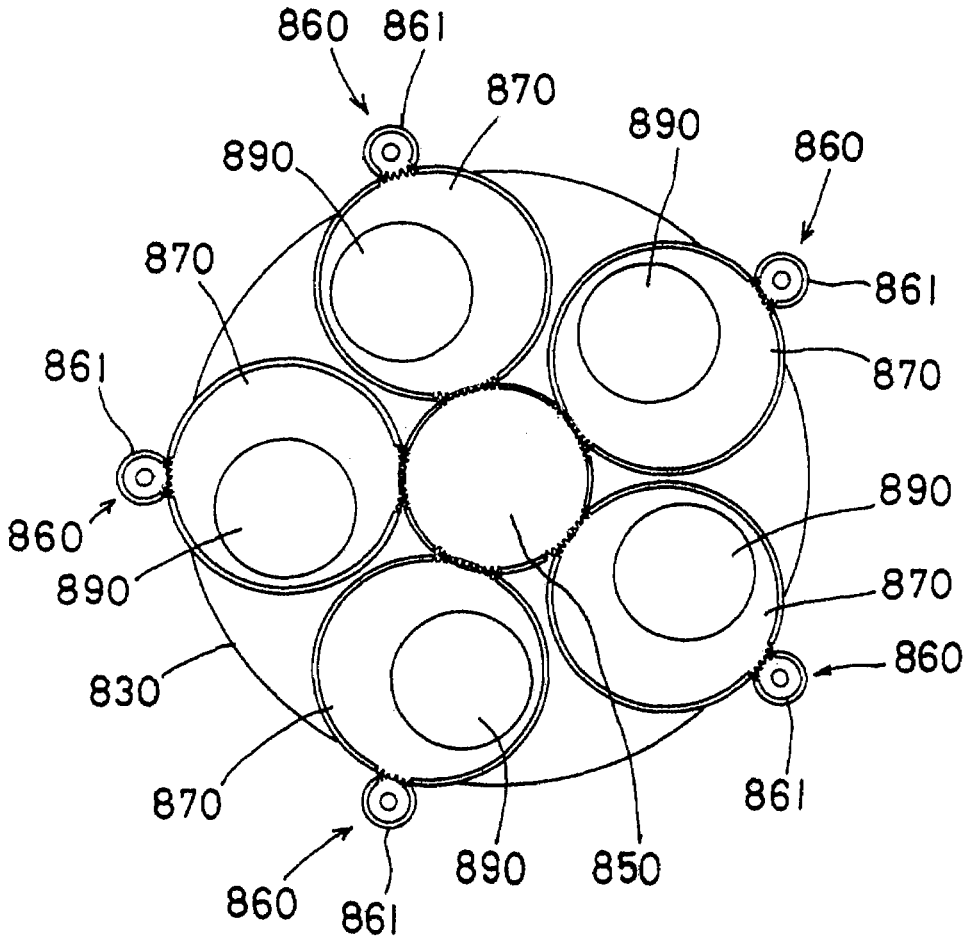
FIG. 15 is a top view of another carrier driving mechanism.
Figure 16:
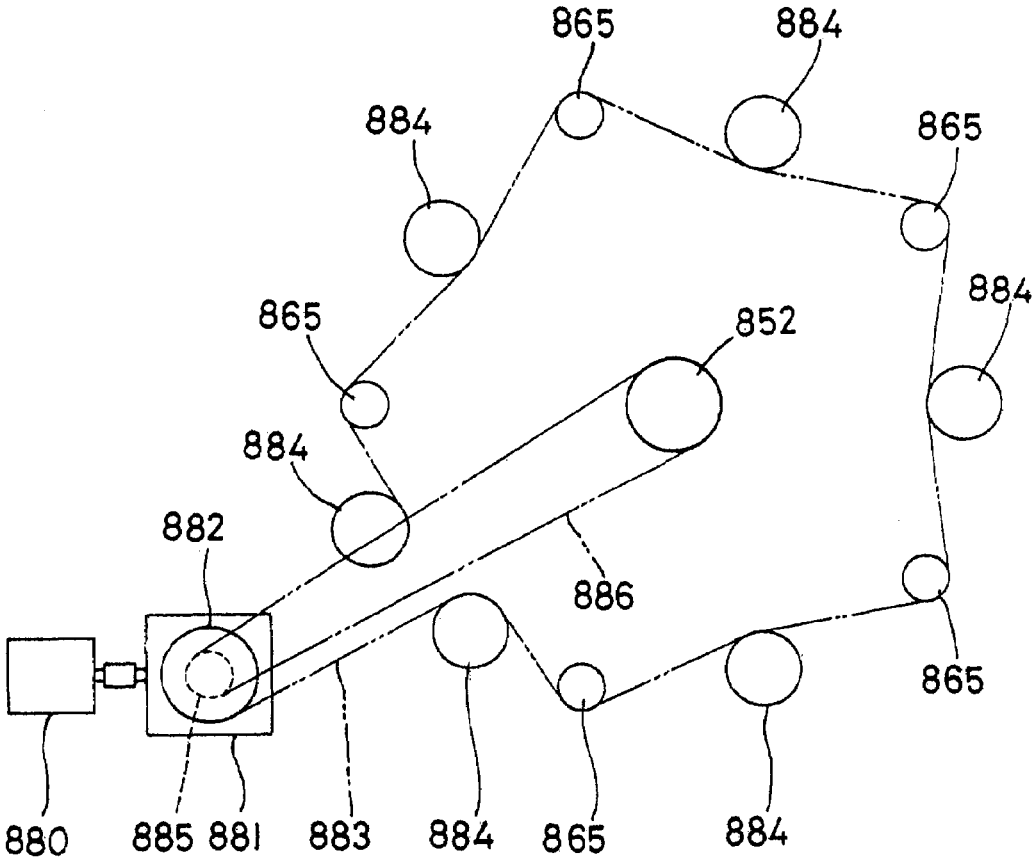
FIG. 16 is a top view of a power transmission system for the carrier driving mechanism in FIG. 15.

Another carrier driving mechanism of the polishing apparatus main body 800 will be described with reference to FIGS. 15 and 16.

This carrier driving mechanism differs from the above described one in the rotation means 860. That is, the rotation means 860 of this carrier driving means each have one rotation gear 861 arranged on a line joining the center of the center gear 850 with the center of the carrier 870. That is, in this rotation means 860, the center gear 850 (the carrier 870??) is engaged with the center 850 and the rotary gear 861 at two positions around its center. The center gear 850 and the rotary gear 861 rotate in the same direction at the same circumferential speed to rotate the carrier 870 at its specified position.

Five carriers 870 are used but this number is not limited. Thus, the number of rotation means 860 installed is not limited. Additionally, the belt can be replaced with a chain.

Figure 17:
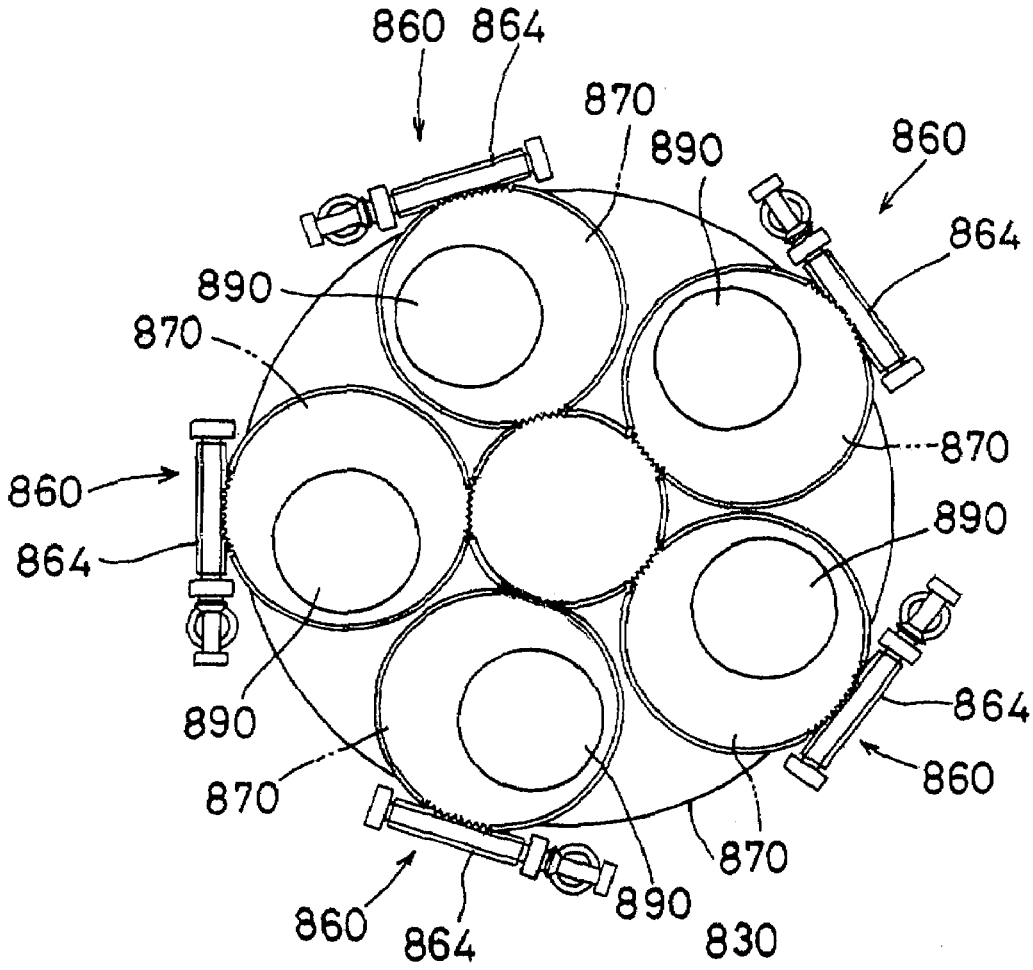
FIG. 17 is a top view of yet another carrier driving mechanism.
Figure 18:
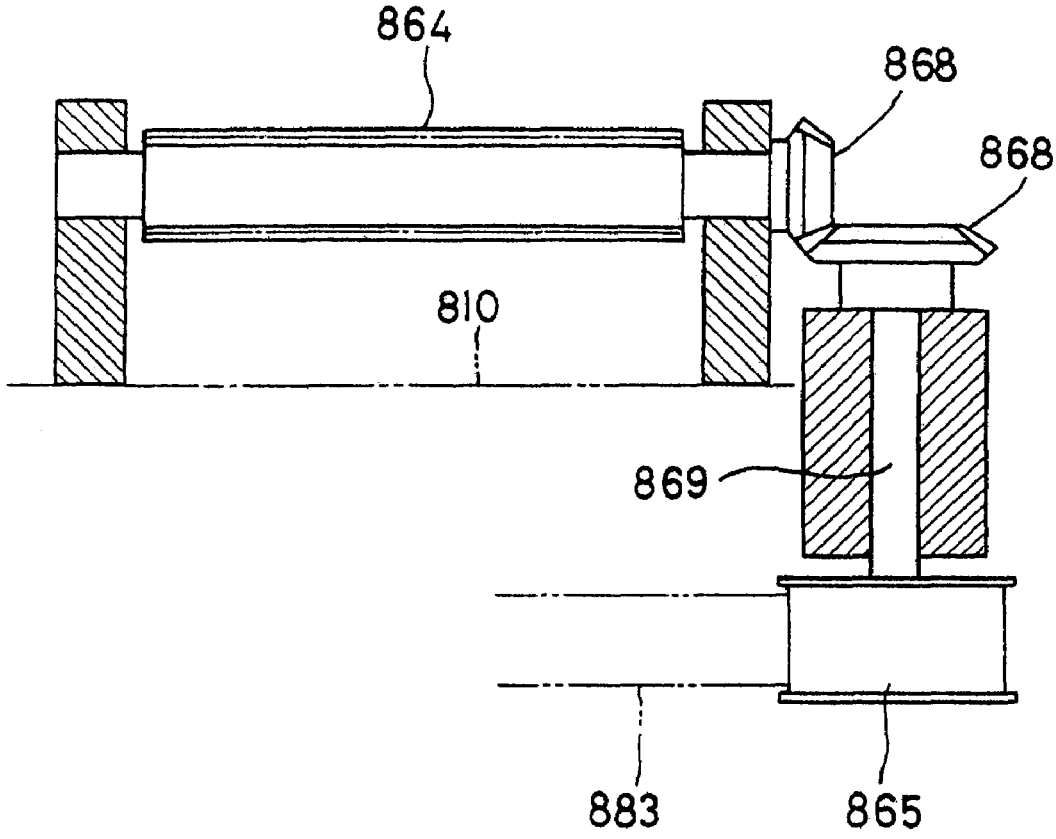
FIG. 18 is a front view of rotation means.
Figure 19:
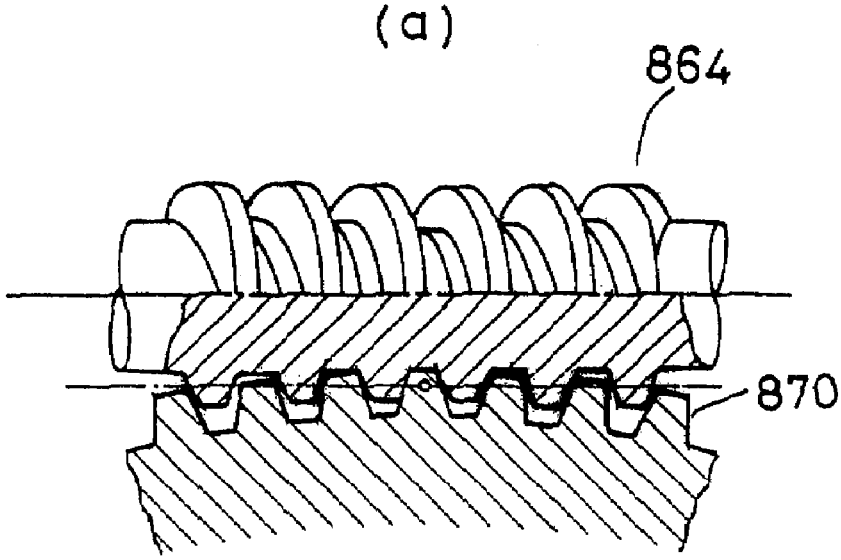
FIG. 19 is a top view of a worm gear.
Figure 19:
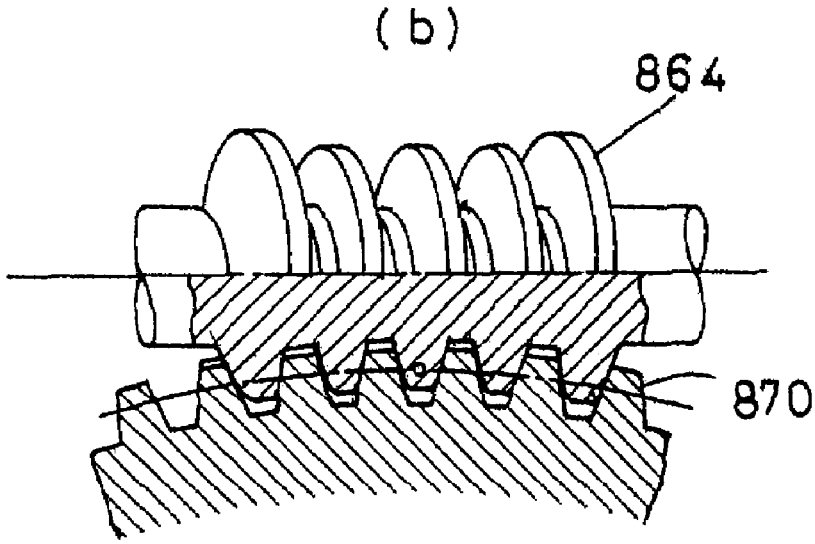

Yet another carrier driving mechanism of the polishing apparatus main body 800 will be described with reference to FIGS. 17 to 19.

The rotation means 860 each have a worm gear 864 of a resin engaging externally with the tooth section 872 of the corresponding carrier 870. The worm gear 864 is rotatably supported in a horizontal direction in the lower frame 810 and externally engages with the carrier 870 on a line joining the center of the center gear 850 with the center of the carrier 870. The worm gear 864 has a vertical drive shaft 869 connected thereto via helical gears 868 and 868 so that a pulley 865 is rotationally driven by the above described drive mechanism to synchronously rotate the worm gears 864 of the rotation means 860 in the same direction.

When the worm gears 864 of the plurality of rotation means 860, 860, . . . disposed around the lower rotary surface plate 830 rotate, the carriers 870, 870, . . . between the rotary surface plates 830 and 840 rotate at their specified positions in the same direction to eccentrically rotationally move the wafers 890, 890, . . . in the carriers 870, 870, . . . . Thus, both surfaces of each of the wafers 890, 890, . . . are simultaneously polished by the polishing pads 839 and 849.

Such double side polishing rotates the carriers 870, 870, . . . at their specified positions in the same direction and does not revolve them around the center gear 850. Thus, no internal gear for revolution is required, thereby preventing a decrease the polishing accuracy caused by manufacturing errors in the internal gear or other factors. Therefore, a polishing accuracy equivalent to or higher than that for the conventional apparatus is obtained for larger apparatuses for carriers 870, 870, . . . of a larger diameter.

Since the internal gear that is substantially as large as the outer diameter of the surface plate is omitted and its drive mechanism is also omitted, the size of the apparatus is reduced even with the addition of the rotation means 860, 860, . . . to thereby reduce costs.

Since the worm gear 864 of each rotation means 860 is composed of a resin, no metallic power result from engagement between the worm gears 864 and the carrier 870. This prevents the wafers 890 from being contaminated with metallic powders. In this regard, the carriers 870 are also made of a resin. Additionally, this worm gear requires lower manufacturing costs than that of metal. There is a possibility that the worm gear will be abraded, but since it contacts with the carrier over a long distance, abrasion caused by the engagement between the worm gear and the carrier 870 is restrained to reduce the frequency of replacement. This effects is enhanced by the use of a hand drum, shown in FIG. 19(*b*).

Although the worm gear 864 is fixed to the position where it engages with the wafer 870, but if it is movable at a right angle to the rotation axis, the operation of setting and removing the carriers 870 is simplified. Five carriers 870 are used but this number is not limited. Thus, the number of rotation means 860 installed is not limited. Additionally, the belt can be replaced with a chain.

Although the above described polishing apparatus main bodies rotate only carriers at their specified positions between the upper and lower rotary surface plates, a planetary gear method can be used which combines with rotations with revolutions.

Another embodiment of the polishing apparatus main body will be described with reference to FIGS. 20 and 21.

A polishing apparatus main body 900 according to this embodiment uses a method for causing wafers to make a planetary motion between the upper and lower rotary surface plates. The polishing apparatus main body 900 comprises an annular lower surface plate 901 supported in the horizontal direction, an annular upper surface plate 902 facing the lower surface plate 901 from above, and a plurality of (typically, 3 or 5) carriers 903, 903, and 903 arranged between the upper and lower surface plates 901 and 902.

The lower surface plate 901 is a disk having no through-hole in its center. The lower surface plate 901 is concentrically mounted on a rotation shaft 916. A sun gear 907 is fixedly mounted on the center of the lower surface plate 901 using bolts. On the other hand, the lower surface plate 901 has an annular waste liquid pan 915 below the lower surface plate 901 for receiving a grinding liquid ejected to a periphery of the lower surface plate 901. The upper surface plate 902 is driven independently of the lower surface plate 901 by means of a drive mechanism (not shown).

The plurality of carriers 903, 903, and 903 are rotatably supported on the lower surface plate 901 in a circumferential direction thereof at equal intervals. The carriers 903 are each what is called a planetary gear that engages with the sun gear 907 provided inside the annular lower surface plate and with an inner gear 908 provided outside it and that holds a wafer 910 eccentrically to the center thereof.

To polish both surfaces of the wafer 910, the upper surface plate 902 is lifted and the wafer 910 is set on the corresponding carrier 903. Then, the lower surface plate 901 and the sun gear 907 are rotated at a low speed and the upper surface plate 902 is lowered. A pin provided on the upper surface plate 902 engages with a guide in a top surface of the sun gear 907 to start rotating the upper surface plate 902. Then, the wafers 910 are sandwiched, under a predetermined pressure, between polishing pads 909 and 909 stuck to opposite surfaces of the upper and lower surface plates 901 and 902, and the rotation speed is set at a predetermined value to start polishing.

The carriers 903 each make a planetary motion comprising rotations and revolutions between the upper and lower surface plates 901 and 902, which are rotating. As a result, the wafer 910 eccentrically held by each carrier 903 makes eccentric rotating and revolving motions between the polishing pads 909 and 909; the combination of these motions serves to evenly polish both surfaces of the wafer.

In this case, a grinding liquid is supplied between the upper and lower surface plates 901 and 902 using a negative pressure resulting from a difference in rotation speed between the upper surface plate 902 and the carriers 903. A supply system for the grinding liquid comprises a grinding liquid pan 911 mounted on a support member 906 of the upper surface plate 902 so that a negative pressure arising from the difference in rotation speed between the upper surface plate 902 and the carriers 903 causes the grinding liquid in the pan to be supplied between the surface plates 901 and 902 through a grinding liquid supply passage 912 formed in the upper surface plate 902.

When both surfaces of the wafer 910 are polished, the negative pressure arising from the difference in rotation speed between the upper surface plate 902 and the carriers 903 causes the grinding liquid in the pan to be supplied between the surface plates 901 and 902 through a grinding liquid supply passage 912 formed in the upper surface plate 902. At this point, the grinding liquid supplied between the upper and lower surface plates 901 and 902 is dammed up by the sun gear 907 screwed to the center of the upper surface plate 901 and is thus not ejected to the center; all the liquid flows only toward the outer peripheries of the surface plates and into the waste liquid pan 915. Thus, the grinding liquid supplied between the upper and lower surface plates 901 and 902 remains over a longer time than it is ejected both toward the centers of the surface plates and toward the outer peripheries thereof, thereby improving usage. In addition, the rotation shaft 916 rotationally driving the lower surface plate 901 will not be contaminated with the grinding liquid. Furthermore, part of the grinding liquid can be supplied to the center without passing through the upper surface plate 902.

The carriers 903, 903, and 903 can make a planetary motion though rotation of the sun gear 907 cannot be independently controlled because it rotates with the lower surface plate 901. Moreover, rotation of the inner gear 908 can still be independently controlled and the plurality of carriers 903, 903, and 903 can be synchronously rotated in the circumferential direction, thereby enabling the carriers 903 and the wafers 910 to make a planetary motion in various manners.

That is, in a conventional structure for allowing the plurality of carriers 903, 903, and 903 to make a planetary motion between the upper and lower surface plates 901 and 902, the lower surface plate 901 is an annular body, and the sun gear 907 and a drive shaft thereof are provided inside the lower surface plate 901, while the ring-shaped inner gear 908 is provided outside it. This structure creates gaps between the lower surface plate 901 and the sun gear 907 and between the lower surface plate 901 and the inner gear 908.

The grinding liquid supplied between the surface plates 901 and 902 using the negative pressure arising from the difference in rotation speed between the surface plates 901 and 902 is not only ejected directly to the waste liquid pan 915 from the gap on the inner gear 908 side but also thereto from the gap on the sun gear 907 through the waste liquid passage 914. That is, the grinding liquid supplied between the surface plates 901 and 902 is ejected both toward the centers of the surface plates and toward the outer peripheries thereof. Consequently, the grinding liquid does not remain between the surface plates 901 and 902 for an sufficient amount of time, and a part thereof is directed to the discharge system without being used for the polishing, thereby degrading the usage.

Additionally, the grinding liquid flowing into the gap on the sun gear 907 side flows into the lower surface plate 901 and a drive section for the sun gear 907, which concentrate in the center of the apparatus, thereby contaminating the a shaft or a bearing of the drive section.

In the polishing apparatus main body 900 according to this embodiment, however, the sun gear 907, allowing the carriers 903 to make a planetary motion between the upper and lower rotary surface plates 901 and 902, is integrated with the lower rotary surface plate 901. The grinding liquid supplied between the upper and lower surface plates 901 and 902 is ejected only toward the outer peripheries thereof to improve the usage of the grinding liquid. Further, the grinding liquid supplied between the upper and lower surface plates 901 and 902 is not ejected to the center thereof, thereby preventing the drive section concentrated in the center from being contaminated.

Figure 22:
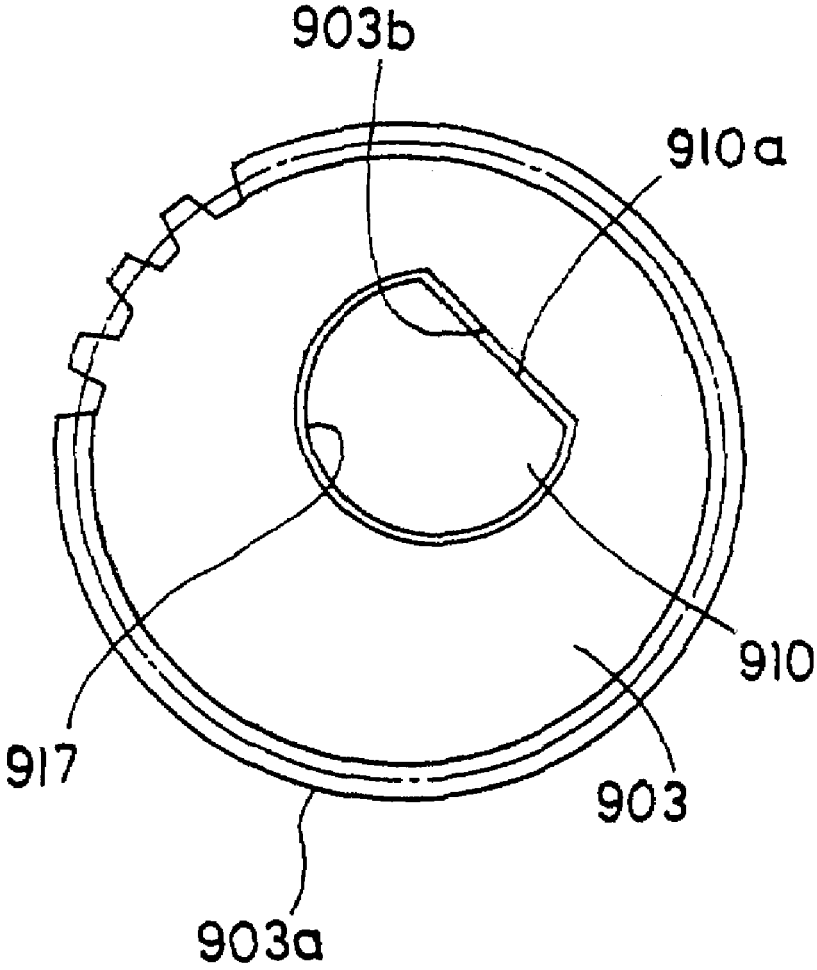
FIG. 22 is a top view of yet another embodiment of the polishing apparatus main body, showing a carrier.

A yet another embodiment of the polishing apparatus main body will be explained with reference to FIGS. 22 and 23.

Figure 20:
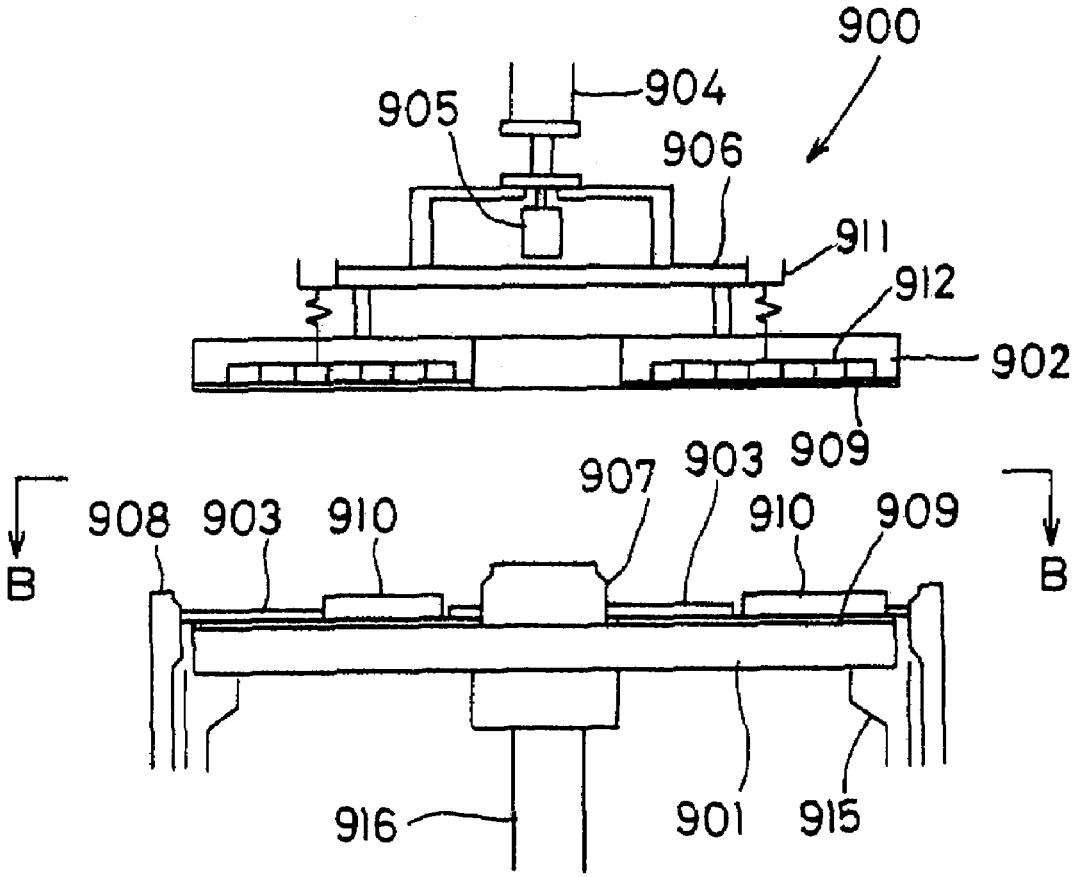
FIG. 20 is a schematic side view showing another embodiment of the polishing apparatus main body.
Figure 21:
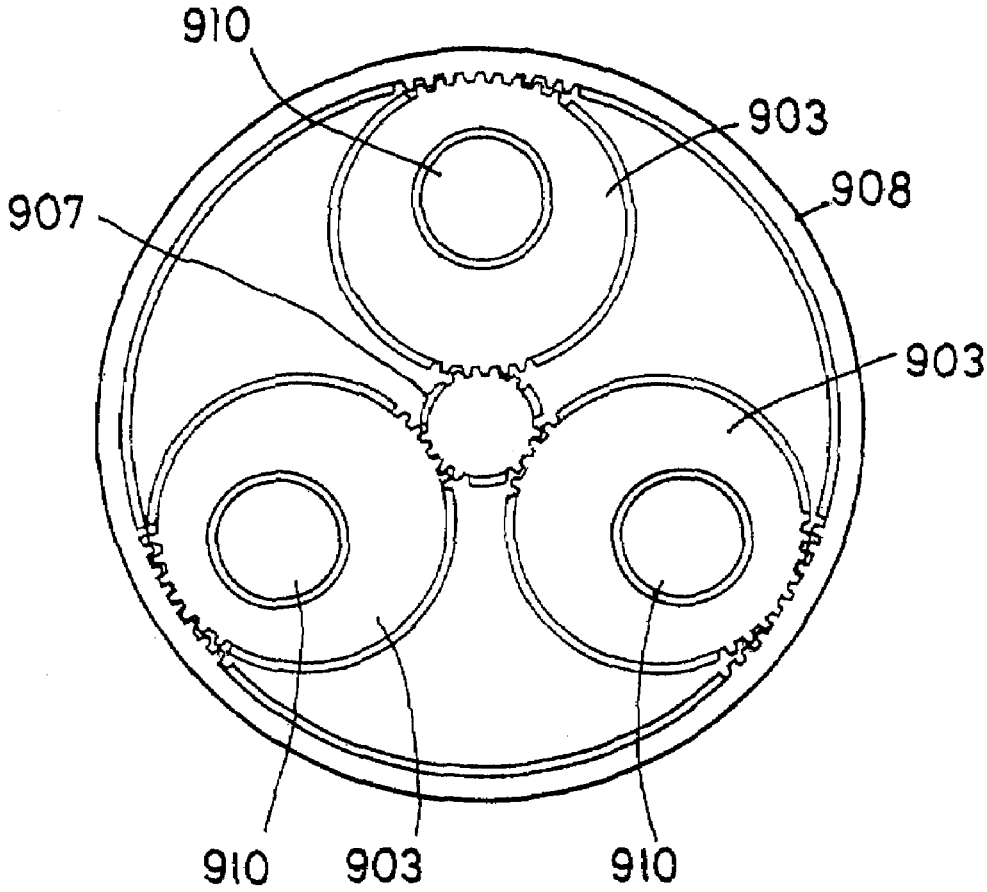
FIG. 21 is a view taken along a line B-B in FIG. 20.

The polishing apparatus main body according to this embodiment differs from that shown in FIGS. 20 and 21 in the carriers 903. The remaining part of the configuration of this main body is the same as that of the polishing apparatus main body shown in FIGS. 20 and 21 and detailed description thereof is thus omitted.

The carrier 903 used for the polishing apparatus main body according to this embodiment is a disk-shaped planetary gear having a tooth section 903*a* formed on its outer circumferential surface and engaging with the sun gear and the inner gear. The carrier 903 has a hole 917 eccentrically formed and in which the wafer 910, extracted from a silicon single crystal rod, is fitted.

The wafer 910 has a notch 910*a* formed on its outer circumferential surface and called a "V notch" indicting a crystal orientation. An inner circumferential surface of the carrier 903 which faces the hole 917 has a V-shaped projection 903*b* over which the notch 910*a* is fitted.

Figure 23:
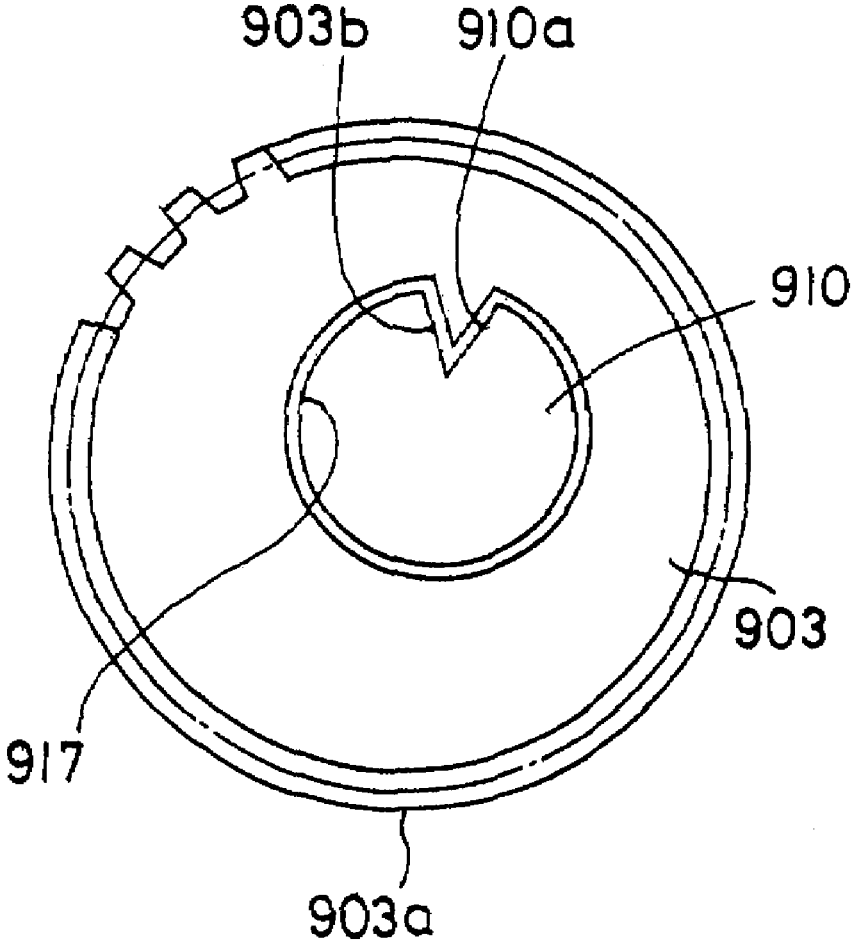
FIG. 23 is a top view of another carrier.

If the notch 910*a* indicating the crystal orientation is a half moon-shaped orientation flat, the projection 903*b* formed in the outer circumferential surface of carrier 903 is also shaped like a half moon so as to corresponding to this orientation flat, as shown in FIG. 23.

The use of this carrier 903 precludes the wafer 910 held in the hole 917 in the carrier 903 from rotating relative to the carrier 903 and allows it to constantly rotate with the carrier 903. Thus, abrasion of a periphery of the wafer 910 caused by the idle phenomenon and resulting damage thereto are avoided to eliminate the possibility that crystal defects such as slip or dislocation will occur when a device is formed.

Additionally, the inner circumferential surface of the carrier 903 is restrained from abrasion, and if the carrier 903 is made of a resin reinforced with glass fibers or the like, the glass in the resin is unlikely to be exposed from the inner circumferential surface, also preventing the wafer 910 from being damaged.

If the inner circumferential surface of the carrier 903 is coated with a resin of a small friction resistance, this prevents the inner circumferential surface of the carrier 903 from being abraded due to changes in abutting surfaces of the carrier 903 and the wafer 910 as the polishing progresses.

That is, the polishing apparatus main body based on the method for allowing the wafers 910 to make a planetary motion between the upper and lower surface plates 901 and 902 requires each wafer 910 to move integrally with the corresponding carrier 903. Accordingly, the diameter of the hole 917 and others are designed so that the wafer 910 held in the hole 917 in the carrier 903 will not run idly.

In an actual polishing operation, however, fine projections on the polishing pad, abrasion of the inner circumferential surface of the carrier 903, an unbalanced supply of the grinding liquid, or the like may preclude the wafer 910 from rotating integrally with the carrier 903, and the wafer 910 may rotate by itself. If the wafer 910 continues running idly, a periphery thereof is abraded and damaged, causing crystal defects such as slip or dislocation when a device is formed.

Additionally, the abrasion of the inner circumferential surface of the carrier 903 is facilitated, and if the carrier 903 is made of a resin reinforced with glass fibers or the like, the glass in the resin is exposed from the inner circumferential surface to damage the wafer 910.

The carrier 903, however, has the projection 903*b* provided on its inner circumferential surface and fitted in the notch 910*a* formed in the outer circumferential surface of the wafer 910, thereby preventing the wafer 910 from running idly within the carrier 903. Thus, the periphery of the wafer 910 is protected to improve the quality and yield thereof. In addition, the inner circumferential surface of the carrier 903 is restrained from abrasion to improve its durability.

Figure 24:
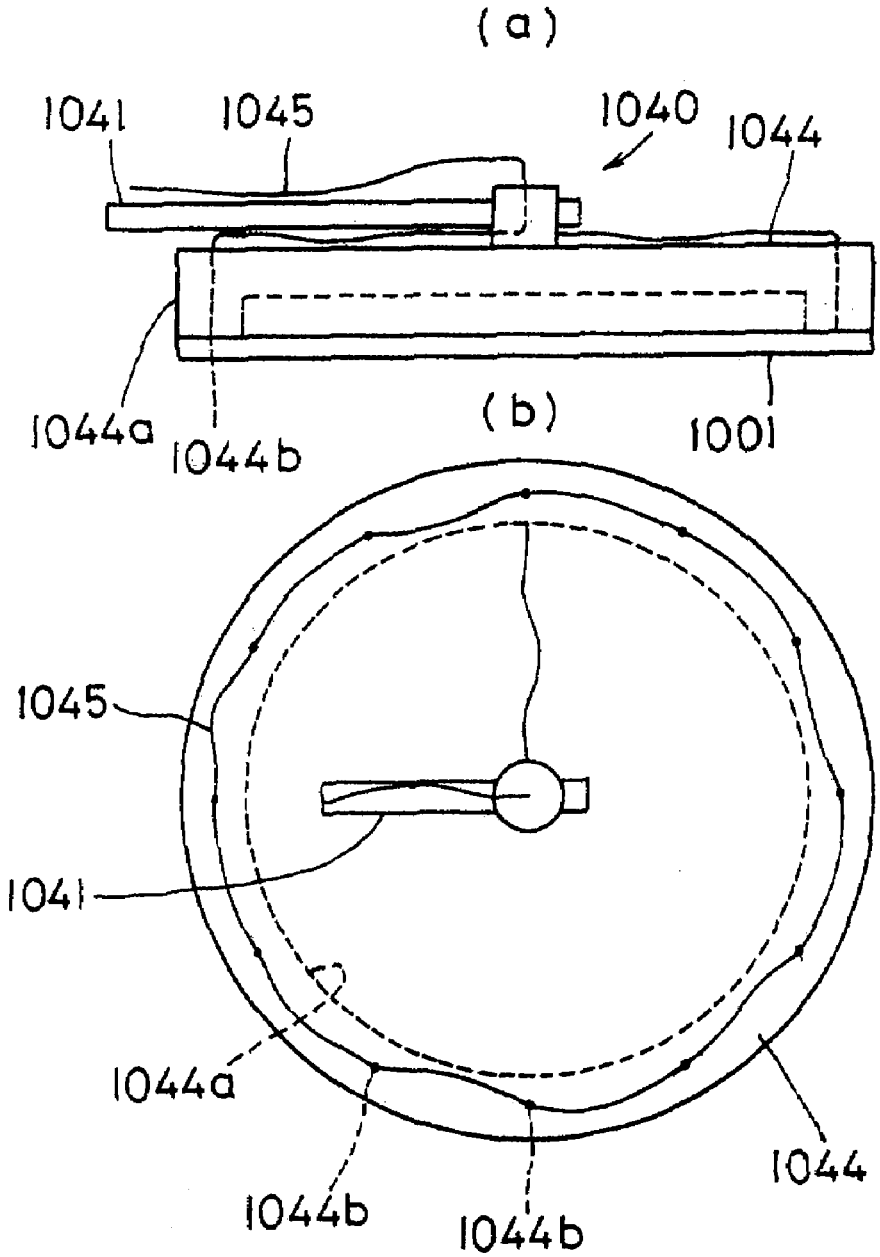
FIG. 24 is a view showing the configuration of an integral part of one embodiment of a wafer transfer and loading apparatus.

Next, a preferred embodiment of a wafer transfer and loading apparatus for the double side polishing apparatus 100 will be explained with reference to FIG. 24.

A wafer transfer and loading apparatus 1040 according to this embodiment is used for the second work conveying section 170 of the double side polishing apparatus 100. The wafer transfer and loading apparatus 1040 comprises a horizontal robot arm driven in X, Z, and θ directions by a drive mechanism (not shown) and a outer circumferential annular sucking type chuck 1044 attached to a tip portion of the robot arm 1041.

The outer circumferential annular sucking type chuck 1044 comprises a disk of the same outer diameter as a wafer 1001. The chuck 1044 is shaped like a cup in which a periphery of its bottom surface annularly projects downward so that only the periphery comes in contact with a top surface of the wafer 1001. An annular projection 1044*a* of the chuck has a plurality of suction ports 1044*b* formed on its bottom surface thereof in the circumferential direction of the chuck at predetermined intervals to suck the wafer 1001. The plurality of suction ports 1044*b* are connected to a suction apparatus (not shown) via a vacuum pipe 1045.

The wafer transfer and loading apparatus is operated as follows:

First, the chuck 1044 is guided to above the wafer 1001 to be transferred and loaded. Then, the chuck 1044 is lowered to bring the bottom surface of the projection 1044*a* into contact with the top surface of a periphery of the wafer 1001. In this state, the plurality of suction ports 1044*b* are used to allow the chuck 1044 to suck the top surface of the entire periphery of the wafer 1001. Then, the chuck 1044 is moved while sucking the wafer and the sucking is stopped once the wafer 1001 is unloaded at a target position. Thus, the unpolished wafer 1001 placed on a load side delivery stage is transferred and loaded in the carrier in the double side polishing apparatus.

This wafer transfer and loading apparatus can also be used to transfer and load a polished wafer 1001 set on the carrier in the double side polishing apparatus, in an unload side delivery stage.

According to this wafer transfer and loading apparatus 1040, the chuck 1044 sucks the top surface of the wafer 1001 but sucks and contacts with only the periphery thereof. Since no device is normally formed in this periphery, it can be contacted with during handling. Consequently, the adverse effects on device formation are minimized.

The projection 1044*a*, which comes in contact with the bottom surface of the wafer 1001, preferably has a width between 3 and 5 mm outside a device forming area. If this width is too small, the wafer 1001 cannot be held appropriately and is unstable. If it is too large, effective portions of the wafer 1001 may be disadvantageously contaminated or damaged.

Figure 25:
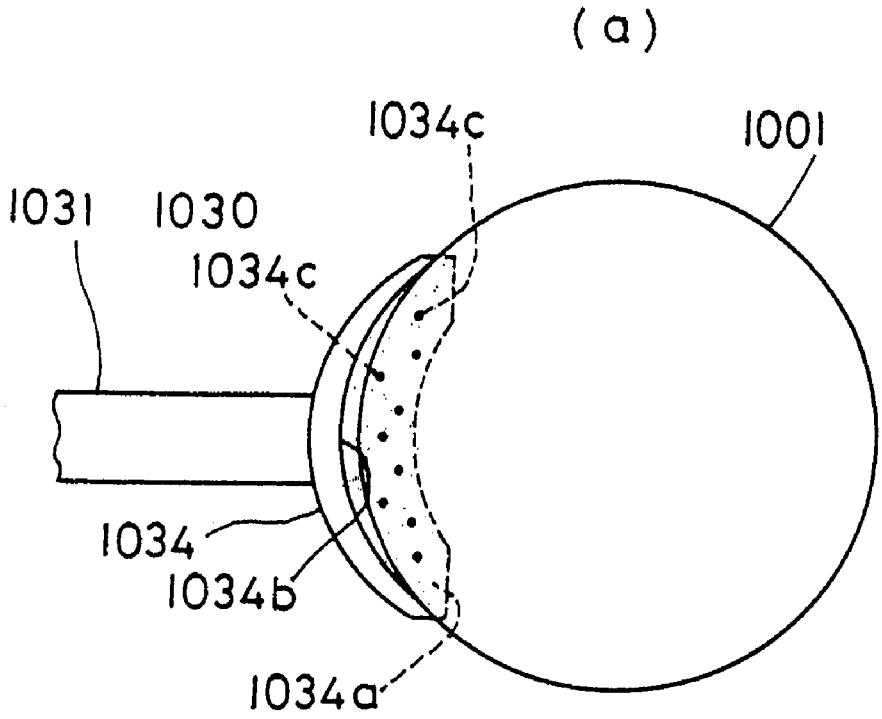
FIG. 25 is a view showing the configuration of an integral part of another embodiment of the wafer transfer and loading apparatus.
Figure 25:
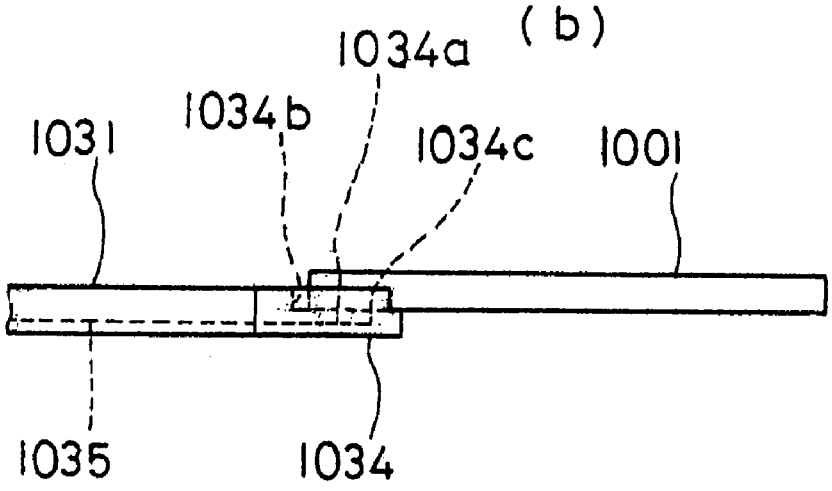
Figure 26:
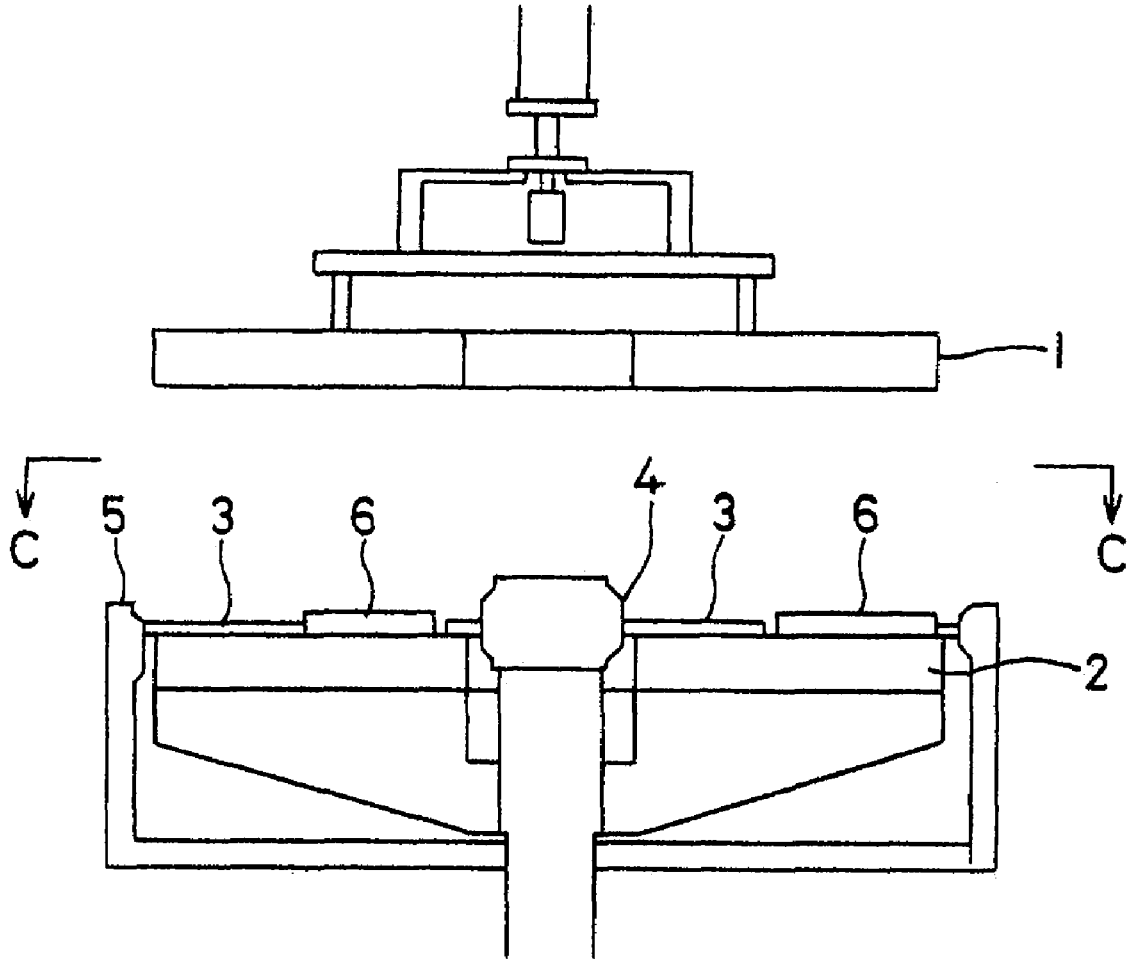
FIG. 26 is a schematic view of the configuration of a double side polishing apparatus.
Figure 27:
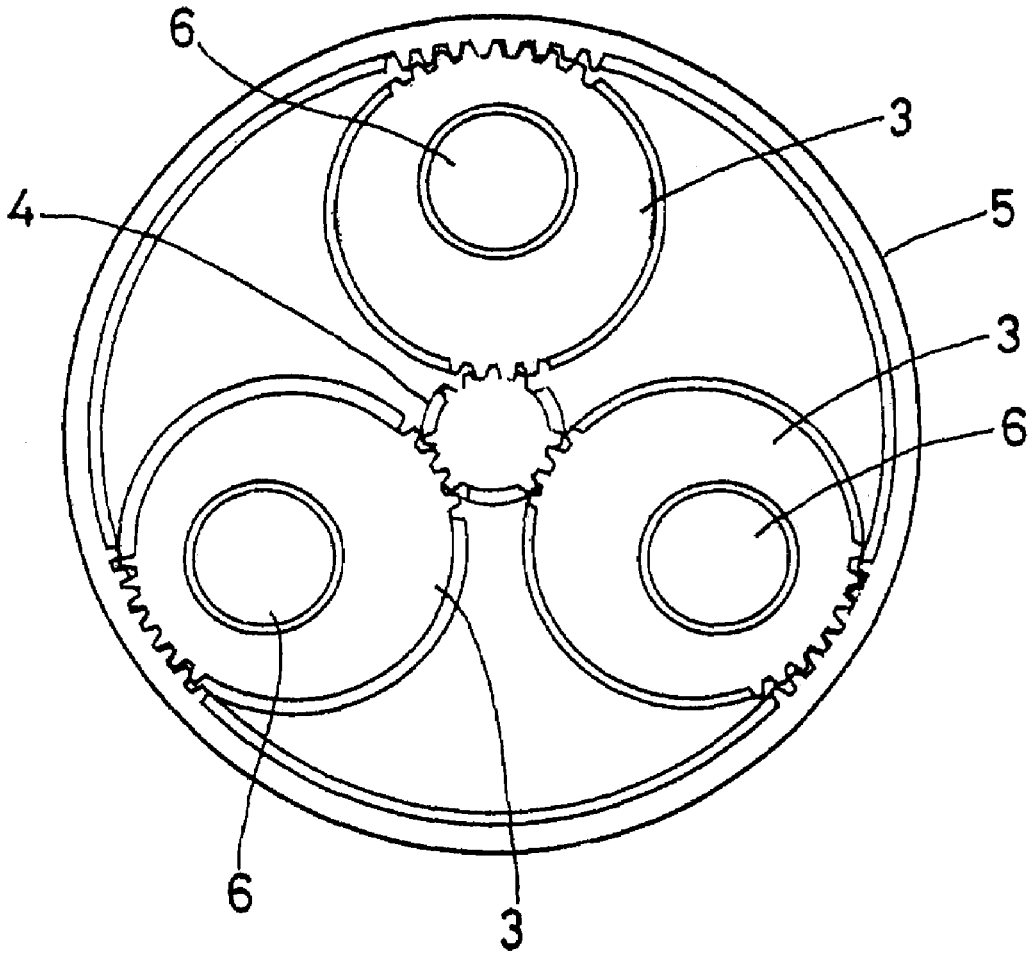
FIG. 27 is a view taken along line C-C in FIG. 12.

Another embodiment of the wafer transfer and loading apparatus will be explained with reference to FIG. 25.

A wafer transfer and loading apparatus 1030 according to this embodiment is used for the first work conveying section 120 of the double side polishing apparatus 100. The wafer transfer and loading apparatus 1030 comprises a horizontal robot arm driven in X, Z, and θ directions by a drive mechanism (not shown) and a outer circumferential annular sucking type chuck 1034 attached to a tip portion of the robot arm 1031.

The outer circumferential annular sucking type chuck 1034 is circularly shaped so as to correspond to the shape of an outer circumferential surface of the wafer 1001. The circular chuck 1034 has a circular horizontal surface 1034*a* that comes in contact with the bottom surface of a periphery of the wafer 1001, a circular vertical surface 1034*b* that abuts on an outer circumferential surface of the periphery, and a plurality of suction ports 1034*c* formed in the circular horizontal surface 1034*a* in the circumferential direction at predetermined intervals, more specifically, distributed all over the horizontal surface 1034*a* in order to suck the wafer 1001. The plurality of suction ports 1034*c* are connected to a suction apparatus (not shown) via the vacuum pipe 1035.

This wafer transfer and loading apparatus is operated as follows:

First, the chuck 1034 is guided to below the periphery of the wafer 1001. Then, the chuck 1044 is lifted to bring its circular horizontal surface 1034*a* into contact with the bottom surface of the periphery of the wafer 1001 while bringing its circular vertical surface 1034*b* into contact with the outer circumferential surface of the periphery. In this state, the plurality of suction ports 1034*c* are used to allow the chuck 1034 to suck part of the bottom of the periphery of the wafer 1001 in the circumferential direction. Then, the chuck 1034 is moved while sucking the wafer and the sucking is stopped once the wafer 1001 is unloaded at a target position. Thus, the unpolished wafer 1001 accommodated in a basket is transferred and loaded in the carrier in a delivery stage.

This wafer transfer and loading apparatus can also be used to transfer and load a polished wafer 1001 placed on the unload side delivery stage, in an unload side basket.

According to this wafer transfer and loading apparatus 1030, the chuck 1044 sucks and holds the wafer 1001 from the bottom surface side but sucks and contacts with only the periphery thereof. Since no device is normally formed in this periphery, it can be contacted with during handling. Consequently, the adverse effects on device formation are minimized.

The horizontal surface 1034*a*, which comes in contact with the bottom surface of the wafer 1001, preferably has a width between 3 and 5 mm outside a device forming area. If this width is too small, the wafer 1001 cannot be held appropriately and is unstable. If it is too large, effective portions of the wafer 1001 may be disadvantageously contaminated or damaged. The horizontal surface 34*a* has a circumferential length between 10° and 150° in terms of the central angle. If this is too small, the wafer 1001 cannot be held appropriately and is unstable. If it is too large, the wafer 1001 cannot be installed in or removed from the basket.

For the double side polishing of wafers, two types of wafer transfer and loading apparatuses are used: a bottom surface sucking type wafer transfer and loading apparatus provided between the basket and the delivery stage to convey wafers from the basket to the delivery stage and a top surface sucking type wafer transfer and loading apparatus provided between the delivery stage and the polishing apparatus main body to convey wafers from the delivery stage to the polishing apparatus main body.

The bottom sucking type wafer transfer and loading apparatus located on the basket side is essential for feeding wafers in the basket. Since, however, a tongue-like sucking type chuck comes in direct contact with the bottom surface of the wafer between its center and its outer periphery, the bottom surface of the wafer may be contaminated or damaged. This is disadvantageous to the double side polishing, which requires equal precision, cleanliness, or the like for both top and bottom surfaces.

The top sucking type wafer transfer and loading apparatus located on the polishing apparatus main body side is essential for setting wafers in the carriers of the polishing apparatus main body and removing the polished wafers from the carriers. Since, however, a disk-shaped entire-surface sucking type chuck comes in direct contact with the entire top surface of the wafer, the top surface may be contaminated or damaged. Of course, this is also disadvantageous to the double side polishing.

The wafer transfer and loading apparatuses 1030 and 1040 according to this embodiment, however, bring the sucking type chucks 1034 and 1044 into surface contact with the surface of the wafer 1001 and can thus reliably hold it. In addition, since the wafer 1001 is in surface contact with the chuck only in its periphery, the adverse effects of handling can be minimized when a device is formed. Therefore, a device can be formed even on a large-diameter wafer with a high yield, the wafer requiring the double side polishing.

INDUSTRIAL APPLICABILITY

As described above, the first double side polishing apparatus according to the present invention combines, before supplying a work to the lower surface plate, the work with the carrier into a separable merged state and supplies the work onto the lower surface plate while it remains merged with the carrier, thereby enabling even a 12-inch silicon wafer to be reliably merged with the carrier. Thus, monitoring and corrections by the operator are obviated to enable the works to be perfectly automatically supplied onto the lower surface plate, thereby enabling even 12-inch silicon wafers to have both surfaces thereof perfectly automatically polished to significantly reduce polishing costs.

In separating the rotary surface plates from each other after the double side polishing, the second double side polishing method and apparatus according to the present invention uses the fluid pressure comprising the liquid injection from above and/or the downward suction to reliably hold the work on the lower rotary surface plate, the work being previously held between the rotary surface plates. This enables the work to be automatically ejected. Moreover, the work is prevented from being damaged or dried to improve its finish quality after both surfaces thereof have been polished.

In this manner, the second double side polishing method and apparatus according to the present invention can inexpensively implement high-quality double side polishing and is thus particularly suitable for polishing silicon wafers, particularly, 12-inch wafers for which high finish quality is required.

The third double side polishing apparatus according to the present invention comprises the housing section arranged between the upper and lower rotary surface plates instead of the plurality of carriers and at least auto rotating between the upper and lower rotary surface plates similarly to the carriers to house the plurality of processing bodies for processing the polishing cloths installed on the opposite surfaces of the upper and lower rotary surface plates, and the conveying section for supplying the plurality of processing bodies between the upper and lower rotary surface plates from the housing section and ejecting the used processing bodies from between the upper and lower rotary surface plates. This third double side polishing apparatus automatically supplies and ejects the brushes or dressers for mechanically processing the polishing clothes, thereby achieving high-quality double side polishing efficiently and economically with frequent brushing or dressing.

Accordingly, the third double side polishing apparatus according to the present invention enables even 12-inch silicon wafers to have both surfaces thereof perfectly automatically polished efficiently and economically to significantly reduce polishing costs.

Additionally, a certain polishing apparatus main body holds and automatically rotates the plurality of carriers between the pair of rotary surface plates at their specified positions to simultaneously polish both surfaces of a plurality of works. Thus, a large precise internal gear is not required to deal with an increase in the size of the work or in the number of works to be simultaneously polished, thereby simplifying the structure to reduce apparatus manufacturing costs. Further, although the internal gear is omitted, this omission serves to reduce an accuracy reducing factor to provide a high polishing accuracy. It further enables the rotary or worm gears for holding and automatically rotating the plurality of carriers at their specified positions to be made of a resin to avoid contaminating the works with metallic powders. Moreover, the rotary gears can be improved to reduce gear costs. Even if the worm gears are made of a resin, they can be restrained from abrasion to reduce costs. Consequently, many large works can be simultaneously polished accurately and efficiently without any possibility of being contaminated.

According to another polishing apparatus main body, the sun gear that causes the carriers to make a planetary motion between the upper and lower rotary surface plates is integrated with the lower rotary gear, so that the grinding liquid supplied between the upper and lower rotary surface plates is ejected only toward the outer peripheries of the surface plates, thereby improving the usage of the grinding liquid. In addition, since the grinding liquid supplied between the upper and lower rotary surface plates is not ejected to the centers of the surface plates, the drive section concentrating in the center can be prevented from being contaminated with the grinding liquid.

According to yet another polishing apparatus main body, the carriers each have the projection provided on its inner circumferential surface and fitted in the notch formed in the outer circumferential surface of the wafer, thereby perfectly preventing the wafer from running idly within the carrier despite the complicated planetary motion of the wafer held in the carrier. Consequently, the periphery of the wafer is protected to improve its quality and yield. Additionally, the inner circumferential surface of the carrier is restrained from abrasion to improve its durability.

According to another polishing apparatus main body, the sucking type chuck is brought into surface contact with the surfaces of the wafers to reliably hold them. Moreover, the wafers are each in surface contact with the chuck only in its periphery, so that even with the double side polishing, the adverse effects of handling can be minimized when a device is formed. Therefore, devices can be formed, with a high yield, on large-diameter wafers requiring the double side polishing.

The invention claimed is:

1. A double side polishing method for at least automatically rotating a plurality of carriers holding works to be polished, between an upper rotary surface plate and a lower rotary surface plate to simultaneously polish both surfaces of a plurality of works held by the plurality of carriers, comprising the steps of:

merging each work with the carrier outside the lower rotary surface plate before supplying the work onto the lower rotary surface plate; and supplying the work merged with the carrier outside the lower rotary surface plate, onto the lower rotary surface plate in a merged state, in which, before merging the work with the carrier outside the lower rotary surface plate, the carrier is conveyed from a carrier housing section that houses the carrier to a carrier aligning section and positioned at a specified location, the work positioned at a location different from the carrier aligning section and is merged with the carrier positioned at the specified location by the carrier aligning section, and the work merged with the carrier by the carrier aligning section is supplied from the carrier aligning section onto the lower rotary surface plate, and such that when the work merged with the carrier is supplied to the lower rotary surface plate, an indexing operation of rotating the lower rotary surface plate through a predetermined angle to supply the work and carrier to their specified position, and the operation of indexing the lower surface plate is performed so as to prevent carriers already placed on the lower rotary surface plate from moving relative to the lower rotary surface plate.

2. The double side polishing method according to claim 1, wherein a polished work is ejected from the lower rotary surface plate.

3. A double side polishing method using a double side polishing apparatus, comprising:

housing a plurality of carriers in a carrier housing section;

aligning each of the carriers;

aligning a corresponding one of a plurality of works to be polished before merging each with an associated one of the carriers;

conveying each of the aligned works into the corresponding aligned carrier so at to merge each of the works with a corresponding one of the carriers outside a polishing apparatus main body;

supplying each of the works merged with the corresponding carrier outside the polishing apparatus main body to a lower rotary surface plate in a merged state;

automatically rotating the plurality of carriers holding the works between an upper and the lower rotary surface plates of the polishing apparatus main body; and simultaneously polishing both surfaces of the plurality of the works held by the plurality of carriers.

4. The double side polishing method according to claim 3, further comprising a step of ejecting the work polished on the lower rotary surface plate to an exterior of the polishing apparatus main body while remaining merged with the carrier.

5. The double side polishing method according to claim 3, further comprising:

polishing both surfaces of the works using a pair of rotary surface plates;

eccentrically holding the works using a plurality of gear-shaped carriers arranged in a periphery of a rotation center between the pair of rotary surface plates;

synchronously rotating the pair of rotary surface plates to engage the plurality of carriers arranged about a center gear; and engaging a plurality of auto rotation mechanisms distributed around the plurality of carriers with a carrier located inside the rotation mechanisms to hold and automatically rotate said carrier at its specified position in corporation with the center gear.

6. The double side polishing method according to claim 5, wherein each of the auto rotation mechanisms engages with the carrier at one or two or more positions and has one or more rotary gears each having a tooth trace along a rotation axis thereof.

7. The double side polishing method according to claim 6, wherein said rotary gear is movable in a rotation axis direction.

8. The double side polishing method according to claim 5, wherein each of the auto rotation mechanisms is configured to automatically rotate the carrier by means of a worm gear.

9. The double side polishing method according to claim 8, wherein said worm gear is made of a resin.

10. The double side polishing method according to claim 3, including:

arranging the plurality of carriers holding the wafers between the upper and lower rotary surface plates at predetermined intervals in the rotation direction, engaging each carrier with a sun gear located in the center of the surface plate and inner gears located in a periphery thereof, to cause each carrier to make a planetary motion between the upper and lower rotary surface plates, supplying grinding liquid between upper and lower rotary surface plates via a plurality of supply passages in the upper rotary surface plate, and wherein a sun gear is integrated at a central part of the lower rotary surface plate.

11. The double side polishing method according to claim 10, wherein the upper rotary surface plate is rotationally driven independently of the lower rotary surface plate.

12. The double side polishing method according to claim 3, wherein each of the works is a wafer, the steps of conveying and supplying including transferring and loading the wafers while supported in a horizontal orientation;

the method further comprising applying a suction to a top surface of each of the wafers, a top sucking chuck made of an outer-circumference annular sucking type that comes in contact with a top surface of a periphery of each of the wafers in the form of an annulus ring and that has a plurality of suction ports in the annular contact surface, the suction ports being formed in a circumferential direction at intervals.

13. The double side polishing method according to claim 3, wherein each of the works is a wafer, the steps of conveying and supplying including transferring and loading the wafers while supported in a horizontal orientation;

the method further comprising supporting each wafers from below while sucking a bottom surface thereof, a bottom sucking chuck made of an outer-circumference arc-shaped sucking type that comes in contact with a circumferential part of a bottom surface of a periphery of each of the wafers in the form of a circular arc and that has a plurality of suction ports in the circular arc contact surface, the suction ports being formed in a circumferential direction at intervals.

* * * * *